US006115573A

United States Patent [19]

Izumi et al.

[11] Patent Number: 6,115,573

[45] Date of Patent: Sep. 5, 2000

[54] IMAGE FORMING APPARATUS AND METHOD USING A DEVELOPING DEVICE RELATING TO INK VISCOSITY AND/OR TEMPERATURE

[75] Inventors: Tomoo Izumi, Osaka; Hiroyuki Yamasaki, Amagasaki; Satoshi Deishi, Ibaraki; Takashi Kondo, Sakai; Katsuhiko Takeda, Toyonaka; Akihito Ikegawa, Sakai, all of Japan

[73] Assignee: Minolta Co., Ltd., Osaka, Japan

[21] Appl. No.: 09/178,495

[22] Filed: Oct. 26, 1998

[30] Foreign Application Priority Data

Oct. 27, 1997 [JP] Japan ..... 9-293710
Oct. 27, 1997 [JP] Japan ..... 9-293711
Oct. 29, 1997 [JP] Japan ..... 9-297182

[51] Int. Cl.[7] ..... G03G 15/10

[52] U.S. Cl. ..... 399/237

[58] Field of Search ..... 399/57, 94, 237, 399/238

[56] References Cited

U.S. PATENT DOCUMENTS 4,272,599 6/1981 Moradzadeh ..... 430/100
5,870,129 2/1999 Ikegawa et al. ..... 347/155
5,923,930 7/1999 Tsukamoto et al. ..... 399/237
5,963,760 10/1999 Takeda et al. ..... 399/237 X
5,983,058 11/1999 Yamasaki et al. ..... 399/237

FOREIGN PATENT DOCUMENTS 7-271107 10/1995 Japan .
7-271198 10/1995 Japan .

*Primary Examiner*—Fred L Braun
*Attorney, Agent, or Firm*—Burns, Doane, Swecker & Mathis, LLP

[57] ABSTRACT

An image forming apparatus includes an image carrying member having an electrostatic latent image carried on its surface, a release agent application device for applying a release agent to the surface of the image carrying member, an ink developing device for bringing an ink into contact with the image carrying member having the electrostatic latent image formed thereon and the release agent applied thereto, to form an ink image corresponding to the electrostatic latent image, and an ink supplying device for supplying a replenishing ink to the ink developing device when the release agent is mixed with the ink in the ink developing device to control the viscosity of the ink, wherein the replenishing ink differs in viscosity from the ink in the ink developing device. And, the supply of ink is varied as a function of the environmental conditions, such as temperature. Image forming methods are disclosed for using the disclosed image forming apparatuses.

19 Claims, 13 Drawing Sheets

IMAGE FORMING APPARATUS AND METHOD USING A DEVELOPING DEVICE RELATING TO INK VISCOSITY AND/OR TEMPERATURE

BACKGROUND OF THE INVENTION

This application is based on applications Nos. 293710/1997, 293711/1997 and 297182/1997 filed in Japan, the contents of which is hereby incorporated by reference.

1. Field of the Invention

The present invention relates to an image forming apparatus so adapted that an electrostatic latent image is formed on the surface of an image carrying member, a non-conductive release agent is applied to the surface of the image carrying member, and ink in an ink developing device is brought into contact with the surface of the image carrying member thus having the electrostatic latent image formed thereon and the release agent applied thereto, to form an ink image corresponding to the electrostatic latent image on the surface of the image carrying member.

2. Description of the Related Art

Conventionally, an image forming apparatus so adapted that an electrostatic latent image is formed on the surface of an image carrying member, and the electrostatic latent image is developed, and is then transferred onto a recording medium such as paper, to form an image on the recording medium has been conventionally used, as represented by an electrophotographic copying machine.

Known as an example of such an image forming apparatus utilizing an electrophotographic system is one using a liquid developer obtained by dispersing colored resin particles (toner particles) in a carrier liquid in order to develop an electrostatic latent image, as disclosed in JP-A-7-271107.

The liquid developer used in the electrophotographic apparatus is generally obtained by dispersing charged toner particles in an insulating carrier liquid. The toner particles are selectively consumed from the liquid developer as an image is formed. When the liquid developer is used, therefore, the density of the toner particles in the carrier liquid must be managed. The management is troublesome. Further, a large part of the carrier liquid is repeatedly used, so that the liquid developer is liable to be degraded.

Furthermore, in the electrophotographic apparatus thus using the liquid developer, when the image is formed on a recording medium such as copying paper, a fixing device for fixing a toner image transferred onto the recording medium, for example, is required. Therefore, the apparatus becomes complicated and is increased in size.

Conventionally, an image forming apparatus so adapted that an electrostatic latent image is formed on the surface of an image carrying member, a non-conductive release agent is applied to the surface of the image carrying member, ink held in an ink carrying member in an ink developing device is brought into contact with the surface of the image carrying member thus having the electrostatic latent image formed thereon and the non-conductive release agent applied thereto, and the ink is made to adhere to a portion, where the electrostatic latent image is formed, on the surface of the image carrying member, to form an ink image corresponding to the electrostatic latent image on the surface of the image carrying member has been proposed, as disclosed in U.S. Pat. No. 4,272,599.

In a case where the ink held in the ink carrying member is brought into contact with the surface of the image carrying member thus coated with the release agent, to form the ink image in the portion, where the electrostatic latent image is formed, on the surface of the image carrying member, the release agent applied to the surface of the image carrying member is introduced into the ink developing device with a part of the release agent held in the ink carrying member, and the release agent is mixed with the ink in the ink developing device, so that the viscosity of the ink in the ink developing device is gradually changed. Consequently, the ink also adheres to a portion, where no electrostatic latent image is formed, on the surface of the image carrying member, so that a formed image is fogged, for example.

In a case where the ink held in the ink carrying member is brought into contact with the surface of the image carrying member coated with the release agent, to form the ink image in the portion, where the electrostatic latent image is formed, on the surface of the image carrying member, as described above, when environmental conditions such as temperature under which the image forming apparatus is employed are changed, the viscosity of the ink in the ink developing device is changed. Consequently, the ink does not suitably adheres to the portion, where the electrostatic latent image is formed, on the surface of the image carrying member, so that the density of a formed image is decreased. Further, the ink also adheres to the portion, where no electrostatic latent image is formed, on the surface of the image carrying member, so that the formed image is fogged, for example.

SUMMARY

An object of the present invention is to prevent, in an image forming apparatus in which ink held in an image carrying member is brought into contact with the surface of an image carrying member coated with a release agent, to form ink image corresponding to an electrostatic latent image on the surface of the image carrying member, as described above, the ink from adhering to a portion, where no electrostatic latent image is formed, on the surface of the image carrying member by the change in the viscosity of the ink even if the release agent is mixed with the ink in the ink developing device, to stably obtain a good image which is not fogged.

Another object of the present invention is to make, in the above-mentioned image forming apparatus, ink suitably adhere only to a portion, where the electrostatic latent image is formed, of the image carrying member even when environmental conditions such as temperature under which the image forming apparatus is employed are changed, to obtain a good image which has a sufficient image density and is not fogged.

A first image forming apparatus according to the present invention comprises an image carrying member having an electrostatic latent image carried on its surface; a release agent application device for applying a release agent to the surface of the image carrying member; an ink developing device for bringing an ink into contact with the image carrying member having the electrostatic latent image formed thereon and the release agent applied thereto, to form an ink image corresponding to the electrostatic latent image; and an ink supplying device for supplying a replenishing ink to the ink developing device when the release agent is mixed with the ink in the ink developing device, wherein said replenishing ink differs in viscosity from the ink in the ink developing device.

A first image forming method according to the present invention comprises the steps of forming an electrostatic latent image on the surface of an image carrying member; applying a release agent to the surface of the image carrying member; bringing an ink into contact with the image carrying member having the electrostatic latent image formed thereon and the release agent applied thereto by an ink developing device, to form an ink image corresponding to the electrostatic latent image; and supplying a replenishing ink to the ink developing device when the release agent is mixed with the ink in the ink developing device, wherein said replenishing ink differs in viscosity from the ink in the ink developing device.

In the first image forming apparatus and the first image forming method according to the present invention, when the release agent applied to the surface of the image carrying member is mixed with the ink in the ink developing device, the replenishing ink which differs in viscosity from the ink in the ink developing device is supplied to the ink developing device from the ink supplying device, thereby preventing the viscosity of the ink in the ink developing device from being changed by the mixing of the release agent.

Even when the release agent is mixed with the ink in the ink developing device, therefore, the viscosity of the ink in the ink developing device is maintained at a suitable value, so that the ink is prevented from adhering to a portion, where no electrostatic latent image is formed, of the image carrying member as in the conventional example. Therefore, a good image which is not fogged is stably formed.

In supplying the replenishing ink which differs in viscosity from the ink in the ink developing device to the ink developing device from the ink supplying device, to adjust the viscosity of the ink in the ink developing device as described above, it is possible to detect the amount of the release agent mixed with the ink on the basis of image data of the electrostatic latent image formed on the surface of the image carrying member, and to carry out such control as to supply the replenishing ink which differs in viscosity from the ink in the ink developing device from the ink supplying device on the basis of the detection.

The amount of the release agent mixed with the ink in the ink developing device is changed by the ratio of the portion, where the electrostatic latent image is formed, on the surface of the image carrying member to the portion, where no electrostatic latent image is formed, on the surface of the image carrying member. Even if the portion where the electrostatic latent image is formed is large, the amount of the release agent mixed with the ink is decreased. If the portion where no electrostatic latent image is formed is larger, the amount of the release agent mixed with the ink is increased.

Specifically, in a case where the ink is brought into contact with the surface of the image carrying member coated with the release agent, to perform development, the ink is electrostatically made to adhere to the surface of the image carrying member upon pushing away the release agent in the portion where the electrostatic latent image is formed, while the release agent is interposed between the surface of the image carrying member and the ink in the portion where no electrostatic latent image is formed. When the ink in contact with the surface of the image carrying member is separated from the image carrying member, the ink which adheres on the surface of the image carrying member is cut between the image carrying member and the ink developing device, so that the ink thus cut remains on the image carrying member in the portion where the electrostatic latent image is formed, while a part of the release agent between the surface of the image carrying member and the ink is cut, so that the part of the release agent thus cut is mixed with the ink in the ink developing device in the portion where no electrostatic latent image is formed.

Therefore, it is possible to accurately detect the amount of the release agent mixed with the ink on the basis of the image data of the electrostatic latent image formed on the surface of the image carrying member. When the amount of the ink, which differs in viscosity from the ink in the ink developing device, supplied to the ink developing device from the ink supplying device is controlled on the basis of the amount of the release agent mixed with the ink whose amount is thus detected, the viscosity of the ink in the ink developing device is maintained at a suitably value even in a case where the release agent is mixed with the ink in the ink developing device. Therefore, a good image which is not fogged is stably formed.

A second image forming apparatus according to the present invention comprises an image carrying member having an electrostatic latent image carried on its surface; a release agent application device for applying a release agent to the surface of the image carrying member; an ink developing device for bringing an ink into contact with the image carrying member having the electrostatic latent image formed thereon and the release agent applied thereto, to form an ink image corresponding to the electrostatic latent image; and a temperature adjusting device for adjusting the temperature of the ink in the ink developing device when the release agent is mixed with the ink in the ink developing device.

A second image forming method according to the present invention comprises the steps of forming an electrostatic latent image on the surface of an image carrying member; applying a release agent to the surface of the image carrying member; bringing an ink into contact with the image carrying member having the electrostatic latent image formed thereon and the release agent applied thereto by an ink developing device, to form an ink image corresponding to the electrostatic latent image; and adjusting the temperature of the ink in the ink developing device when the release agent is mixed with the ink in the ink developing device.

In the second image forming apparatus and the second image forming method according to the present invention, when the release agent applied to the surface of the image carrying member is mixed with the ink in the ink developing device, the temperature of the ink in the ink developing device is adjusted by the temperature adjusting device, thereby preventing the viscosity of the ink in the ink developing device from being changed by the mixing of the release agent.

Even when the release agent is mixed with the ink in the ink developing device, therefore, the viscosity of the ink in the ink developing device is maintained at a suitable value, so that the ink is prevented from adhering to a portion, where no electrostatic latent image is formed, of the image carrying member, as in the conventional example. Therefore, a good image which is not fogged is stably formed.

Even in adjusting the temperature of the ink in the ink developing device by the temperature adjusting device as described above, it is possible to detect the amount of the release agent mixed with the ink on the basis of image data of the electrostatic latent image formed on the surface of the image carrying member, as in the above-mentioned case, and to control the temperature of the ink in the ink developing device by the temperature adjusting device on the basis of the detection.

A third image forming apparatus according to the present invention comprises an image carrying member having an electrostatic latent image carried on its surface; a release agent application device for applying a release agent to the surface of the image carrying member; an ink developing device for bringing an ink into contact with the image carrying member having the electrostatic latent image formed thereon and the release agent applied thereto, to form an ink image corresponding to the electrostatic latent image; detecting means for detecting the change in an environment in which the image forming apparatus is employed; and first controlling means for controlling a time period elapsed until the ink reaches the surface of the image carrying member having the electrostatic latent image formed thereon through the release agent depending on the change in the environment detected by the detecting means.

A third image forming method according to the present invention comprises the steps of forming an electrostatic latent image on the surface of an image carrying member; applying a release agent to the surface of the image carrying member; bringing an ink into contact with the image carrying member having the electrostatic latent image formed thereon and the release agent applied thereto by an ink developing device, to form an ink image corresponding to the electrostatic latent image; and controlling a time period elapsed until the ink reaches the surface of the image carrying member having the electrostatic latent image formed thereon through the release agent depending on the change in an environment in which the image forming apparatus is employed.

In the third image forming apparatus and the third image forming apparatus according to the present invention, examples of a method of controlling the time period elapsed until the ink in the ink developing device reaches the surface of the image carrying member having the electrostatic latent image formed thereon through the release agent include a method of controlling the thickness of a non-conductive release agent applied to the surface of the image carrying member, a method of controlling the viscosity of a non-conductive release agent applied to the surface of the image carrying member, and a method of controlling the viscosity of the ink in the ink developing device.

When the time period elapsed until the ink in the ink developing device reaches the surface of the image carrying member having the electrostatic latent image formed thereon through the release agent is thus controlled such that the ink suitably reaches only a portion, where the electrostatic latent image is formed, on the surface of the image carrying member through the release agent, a good image which has a sufficient image density and is not fogged is obtained.

A fourth image forming apparatus according to the present invention comprises an image carrying member having an electrostatic latent image carried on its surface; a release agent application device for applying a release agent to the surface of the image carrying member; an ink developing device for bringing an ink into contact with the image carrying member having the electrostatic latent image formed thereon and the release agent applied thereto, to form an ink image corresponding to the electrostatic latent image; detecting means for detecting the change in an environment in which the image forming apparatus is employed; and second controlling means for controlling, when an ink image is formed on the image carrying member by the ink developing device, a time period elapsed from the time when the ink is brought into contact with the image carrying member coated with the release agent until it is separated therefrom depending on the change in the environment detected by the detecting means.

A fourth image forming method according to the present invention comprises the steps of forming an electrostatic latent image on the surface of an image carrying member; applying a release agent to the surface of the image carrying member; bringing an ink into contact with the image carrying member having the electrostatic latent image formed thereon and the release agent applied thereto by an ink developing device, to form an ink image corresponding to the electrostatic latent image; and controlling a time period elapsed from the time when the ink is brought into contact with the image carrying member coated with the release agent until it is separated therefrom in the step of forming the ink image depending on the change in an environment in which the image forming apparatus is employed.

In the fourth image forming apparatus and the fourth image forming method according to the present invention, examples of a method of controlling the time period elapsed from the time when the ink is brought into contact with the surface of the image carrying member coated with the release agent until it is separated therefrom include a method of controlling the speed at which the image carrying member moves, and a method of controlling the distance from the point where the ink in the ink developing device is brought into contact with the surface of the image carrying member coated with the release agent to the point where it is separated therefrom.

When the time period elapsed from the time when the ink is brought into contact with the surface of the image carrying member coated with the release agent until it is separated therefrom is thus controlled such that the ink suitably reaches only a portion, where the electronic latent image is formed, on the surface of the image carrying member through the release agent, a good image which has a sufficient image density and is not fogged is obtained.

It is possible to use, as the image carrying member used in each of the image forming apparatuses and the image forming methods in the present invention, an image carrying member in which a dielectric layer is formed on the surface of an electrically conductive member, and an electrophotographic photoreceptor in which a photosensitive layer is formed on the surface of an electrically conductive member.

In the image carrying member, examples of a material composing the electrically conductive member include metals such as aluminum, iron, copper, nickel, SUS, gold, silver, chromium, platinum, tin, and titanium, and alloys of the metals, and resins having any of the conductive materials dispersed therein. In dispersing any of the conductive materials in the resin as described above, it is possible to use, as the resin, polyethylene, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, a polyurethane elastomer, polyamide, polyimide, etc.

Examples of a material composing the dielectric layer provided on the electrically conductive member include resins such as polyester, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, polyurethane elastomer, viscose rayon, cellulose nitrate, cellulose acetate, cellulose triacetate, cellulose propionate, cellulose acetate butyrate, ethyl cellulose, regenerated cellulose, polyamide (nylon 6, nylon 66, nylon 11, nylon 12, nylon 46, etc.), polyimide, polysulfone, polyether sulfone, polyvinyl chloride, a vinyl chloride-vinyl acetate copolymer, polyvinylidene chloride, a vinylidene chloridevinyl chloride copolymer, a vinyl nitrile rubber alloy, polytetrafluoroethylene, polychlorofluoroethylene, polyvinyl fluoride, and polyvinylidene fluoride, and inorganic materials composed of ceramics such as $Al_2O_3$, $SiO_2$, or $TiO_2$. It is also possible to use a combination of two or more types of dielectric materials.

As the photosensitive layer provided on the electrically conductive member, it is possible to use a photosensitive layer which is generally used in the electrophotographic photoreceptor.

As a latent image forming device for forming an electrostatic latent image on the surface of the image carrying member, when an image carrying member so adapted that a dielectric layer is formed on the surface of an electrically conductive member is used, a discharger, an electrostatic head of an ion flow type, or the like for applying charge corresponding to an image to the dielectric layer on the surface of the image carrying member to form an electrostatic latent image is used. On the other hand, when an image carrying member composed of a photoreceptor so adapted that a photosensitive layer is formed on the surface of an electrically conductive member is used, a charger for charging the surface of the image carrying member and various types of exposing devices such as a laser device for exposing the surface of the image carrying member thus charged are used in combination.

There and other objects, advantages and features of the invention will become apparent from the following description thereof taken in conjunction with the accompanying drawings which illustrate specific embodiment of the invention.

DESCRIPTION OF THE PREFERRED EMBODIMENTS

An image forming apparatus and an image forming method according to a preferred embodiment of the present invention will be specifically described on the basis of the accompanying drawings.

(Embodiment 1)

Figure 1:
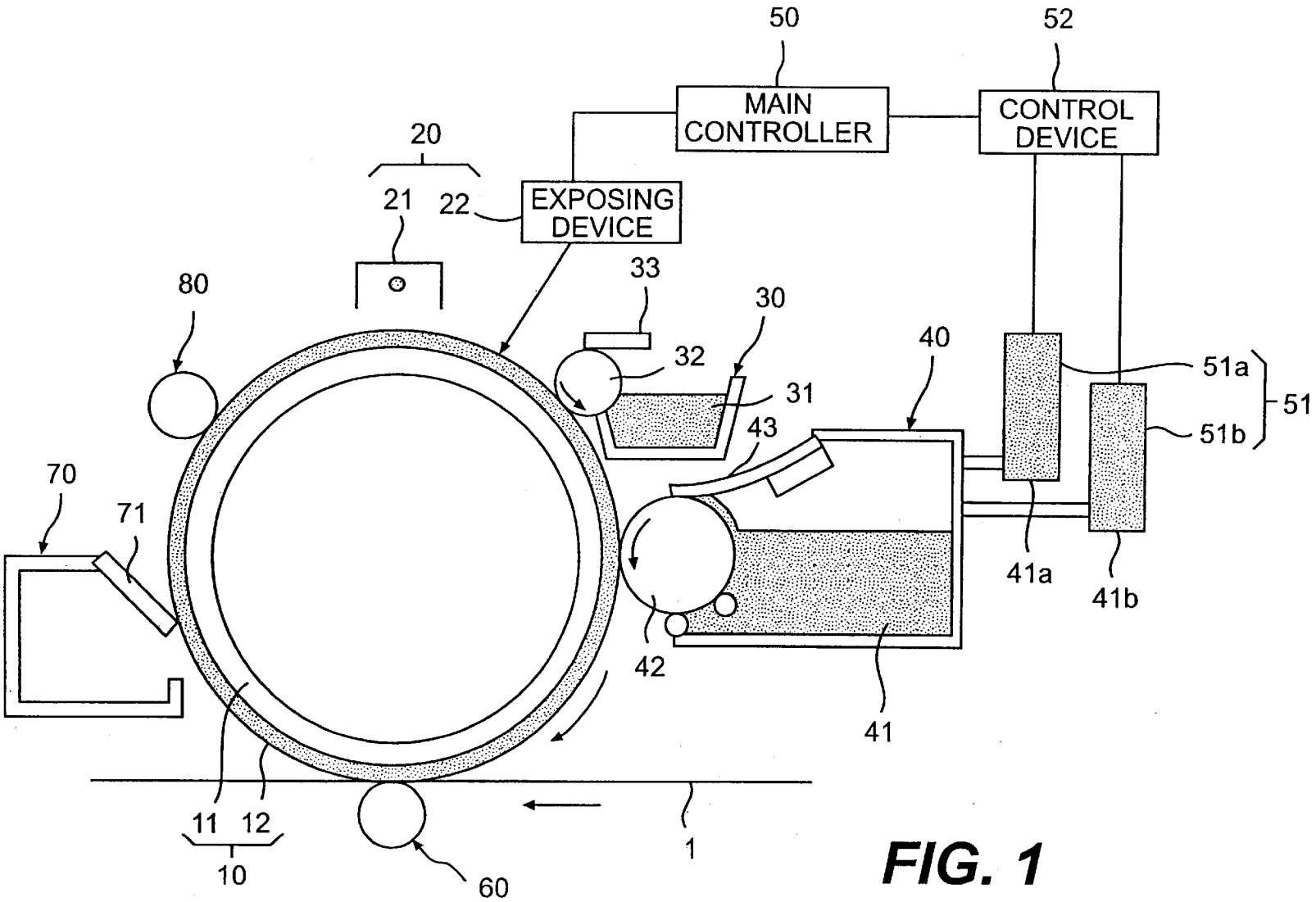
FIG. 1 is a schematic explanatory view showing an image forming apparatus according to an embodiment 1 of the present invention.

In an image forming apparatus according to an embodiment 1, an image carrying member 10 so constructed that a photosensitive layer 12 is formed on the surface of an electrically conductive member 11 is used, as shown in FIG. 1. The image carrying member 10 is rotated, to from an electrostatic latent image on the surface of the image carrying member 10 by a latent image forming device 20.

In the image forming apparatus according to the present embodiment 1, used as the latent image forming device 20 are a charger 21 for uniformly charging the surface of the image carrying member 10 and an exposing device 22 for subjecting the charged surface of the image carrying member 10 to exposure corresponding to image data fed from a main controller 50. After the surface of the image carrying member 10 is uniformly charged by the charger 21, the surface of the image carrying member 10 is subjected to the exposure corresponding to the image data from the exposing device 22, to an electrostatic latent image on the surface of the image carrying member 10.

A non-conductive release agent 31 is then applied to the surface of the image carrying member 10 having the electrostatic latent image thus formed thereon from a release agent application device 30.

In applying the non-conductive release agent 31 to the surface of the image carrying member 10 by the release agent application device 30, silicone oil, for example, is used as the release agent 31. The release agent 31 is contained in the release agent application device 30. An application roller 32 is rotated with the release agent 31 thus contained held on an outer peripheral surface of the application roller 32. The amount of the release agent 31 held on the application roller 32 is regulated by a blade 33, to make such adjustment that the release agent 31 has a predetermined thickness. Thereafter, the release agent 31 is introduced into the image carrying member 10 by the application roller 32, to apply the release agent 31 to the surface of the image carrying member so as to have a suitable thickness.

Ink 41 is then supplied from an ink developing device 40 to the image carrying member 10 thus coated with the release agent 31. The ink 41 is supplied to a portion, where the electrostatic latent image is formed, on the surface of the image carrying member 10, to form an ink image corresponding to the electrostatic latent image on the surface of the image carrying member 10.

In the ink developing device 40, the ink 41 is contained in the ink developing device 40, the ink 41 is held on the surface of an ink carrying member 42 in a drum shape, and the ink carrying member 42 is rotated, to convey the ink 41 held on the surface of the ink carrying member 42. The amount of the ink 41 is regulated by a regulating member 43, to make such adjustment that the ink 41 conveyed with it being held on the surface of the ink carrying member 42 has a predetermined thickness. The ink 41 thus held so as to have a predetermined thickness in the ink carrying member 42 is brought into contact with the surface of the image carrying member 10, to form an ink image corresponding to the electrostatic latent image formed on the surface of the image carrying member 10.

After the ink image is thus formed on the surface of the image carrying member 10, the ink image formed on the surface of the image carrying member 10 is transferred onto a recording medium 1 by a transfer roller 60, while the ink 41 remaining on the surface of the image carrying member 10 after the transfer is removed from the surface of the image carrying member 10 by a cleaning device 70 using a cleaning blade 71. Thereafter, charge remaining on the surface of the image carrying member 10 is eliminated by a charge eliminating device 80, and a new electrostatic latent image is formed again on the surface of the image carrying member 10 by the latent image forming device 20. The above-mentioned operations are repeated, to an image.

In the image forming apparatus according to the present embodiment 1, provided as an ink supplying device 51 for supplying the ink 41 to the ink developing device 40 are a first ink supplying device 51*a* for supplying ink 41*a* having a higher viscosity than that of the ink 41 contained in the ink developing device 40 and a second ink supplying device 51*b* for supplying ink 41*b* having a viscosity which is approximately the same as or not more than that of the ink 41 in the ink developing device 40.

Image data of the electrostatic latent image formed on the surface of the image carrying member 10 is fed to a control device 52 for controlling the ink supplying device 51 from the main controller 50 for feeding image data to the exposing device 22, to detect the amount of the release agent 31 mixed with the ink 41 in the ink developing device 40 by the control device 52 on the basis of the image data.

The amount of the ink 41 supplied from each of the ink supplying devices 51*a* and 51*b* is controlled by the control device 52 on the basis of the amount of the release agent 31 thus detected, to make such adjustment that the ink 41 in the ink developing device 40 has a suitable viscosity. For example, in a case where the viscosity of the ink 41 in the ink developing device 40 is decreased by the increase in the amount of the release agent 31 mixed with the ink 41, the ink 41*a* having a high viscosity is supplied to the ink developing device 40 from the first ink supplying device 51*a*, to increase the viscosity of the ink 41 in the ink developing device 40. The viscosity of the ink 41 is thus maintained at a suitable value even when the release agent 31 is mixed with the ink 41.

When the viscosity of the ink 41 in the ink developing device 40 is thus suitably maintained, a time period elapsed until the ink 41 reaches a portion, where the electrostatic latent image is formed, on the surface of the image carrying member 10, for example, is fixed. Therefore, a good image which is not fogged is stably formed.

(Embodiment 2)

Figure 2:
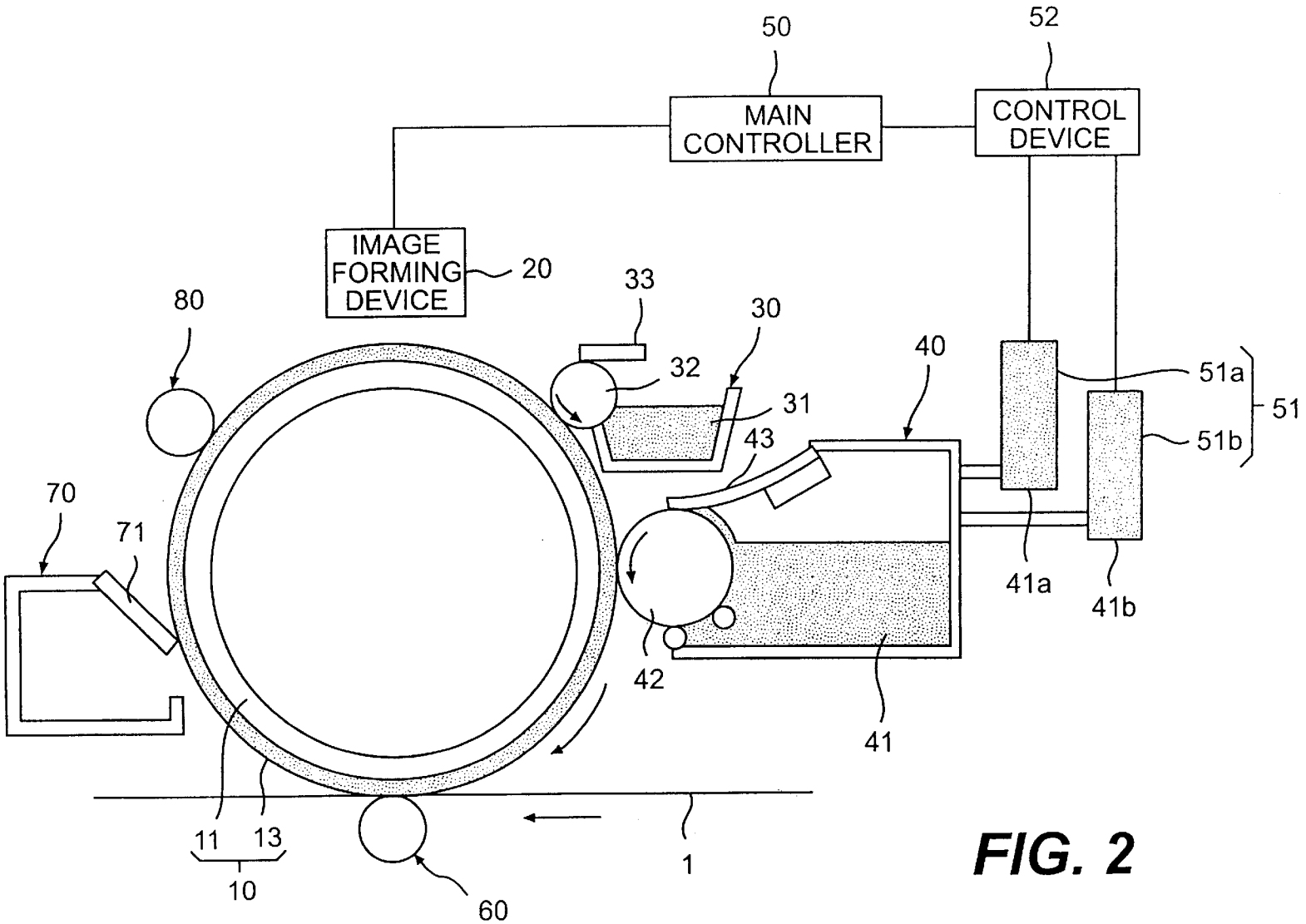
FIG. 2 is a schematic explanatory view showing an image forming apparatus according to an embodiment 2 of the present invention.

In an image forming apparatus according to an embodiment 2, an image carrying member 10 so constructed that a dielectric layer 13 is formed on the surface of an electrically conductive member 11 is used, as shown in FIG. 2.

In the image forming apparatus according to the present embodiment 2, in forming an electrostatic latent image on the surface on the image carrying member 10 in which the dielectric layer 13 is formed on the surface of the electrically conductive member 11 by a latent image forming device 20, used as the latent image forming device 20 is a latent image forming device 20 such as an electrostatic head of an ion flow type, as shown in FIG. 2. The surface of the image carrying member 10 is selectively charged by the latent image forming device 20 on the basis of image data of the electrostatic latent image fed from a main controller 50, to form the electrostatic latent image. Thereafter, an image is formed in the same manner as that in the above-mentioned image forming apparatus according to the embodiment 1.

Also in the image forming apparatus according to the present embodiment 2, the amount of a release agent 31 mixed with ink 41 in an ink developing device 40 is detected by a control device 52 on the basis of the image data of the electrostatic latent image fed from the main controller 50, and the amount of the ink 41 supplied from each of ink supplying devices 51*a* and 51*b* is controlled by the control device 52 on the basis of the detection, to make such adjustment that the ink 41 in the ink developing device 40 has a suitable viscosity.

Consequently, a good image which is not fogged is stably formed, as in the image forming apparatus according to the embodiment 1.

(Embodiment 3)

Figure 3:
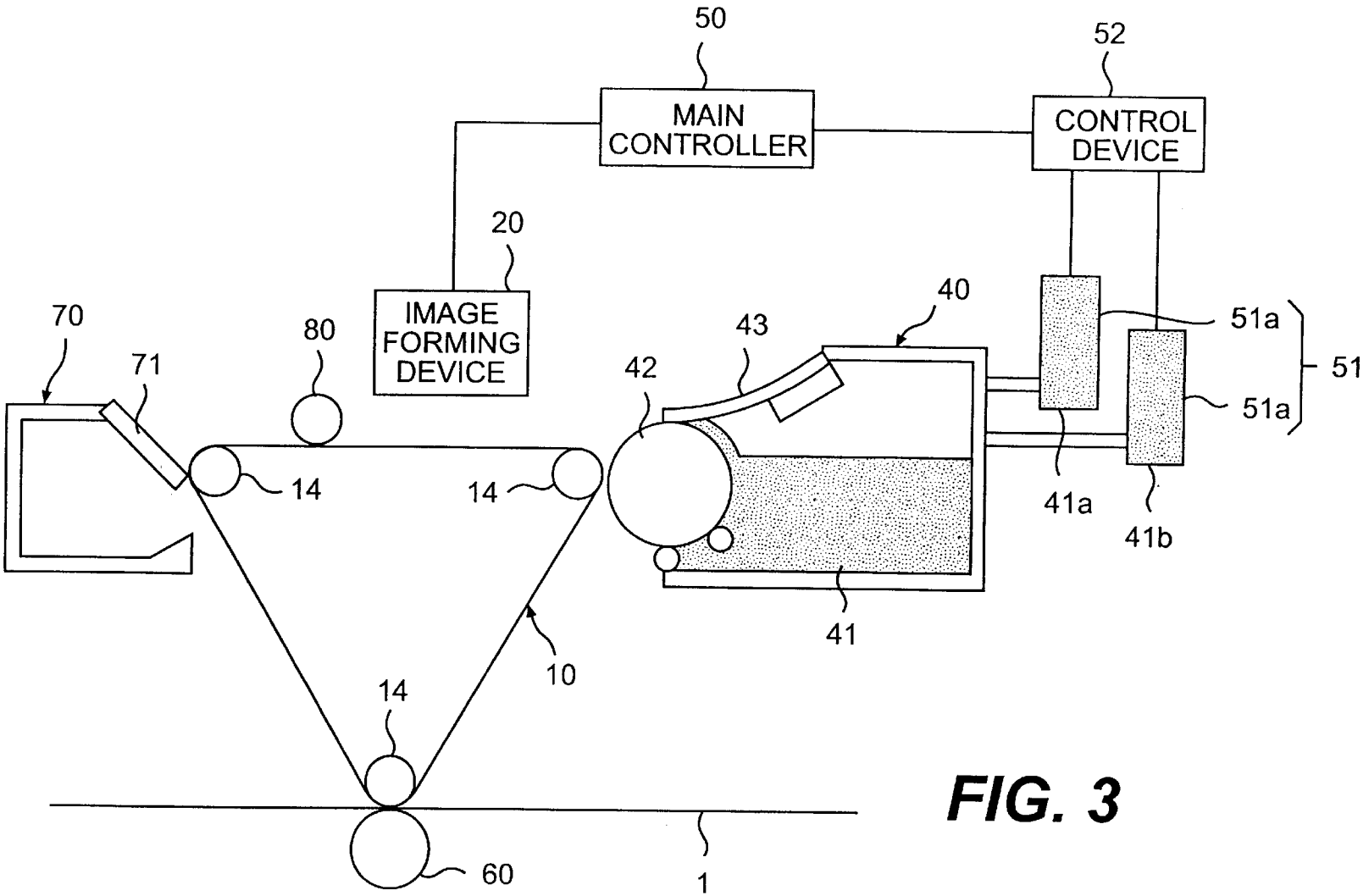
FIG. 3 is a schematic explanatory view showing an image forming apparatus according to an embodiment 3 of the present invention.

In an image forming apparatus according to an embodiment 3, an image carrying member 10 in an endless belt shape so constructed that a dielectric layer is formed on the surface of an electrically conductive member is used, as shown in FIG. 3. The image carrying member 10 is stretched among a plurality of rollers 14, to move the image carrying member 10 as the rollers 14 are rotated.

In the image forming apparatus according to the present embodiment 3, a latent image forming device 20 such as an electrostatic head of an ion flow type is used, as in the above-mentioned embodiment 2. The surface of the image carrying member 10 in a belt shape is selectively charged by the latent image forming device 20 on the basis of image data of an electrostatic latent image fed from a main controller 50, to form the electrostatic latent image on the surface of the image carrying member 10. Therefore, an image is formed in the same manner as those in the above-mentioned image forming apparatuses according to the embodiments 1 and 2.

Also in the image forming apparatus according to the present embodiment 3, the amount of a release agent 31 mixed with ink 41 in an ink developing device 40 is detected by a control device 52 on the basis of the image data of the electrostatic latent image fed from the main controller 50, and the amount of ink 41 supplied from each of ink supplying devices 51*a* and 51*b* is controlled by a control device 52 on the basis of the detection, to make such adjustment that the ink 41 in the ink developing device 40 has a suitable viscosity.

Consequently, a good image which is not fogged is stably formed, as in the image forming apparatuses according to the embodiments 1 and 2.

(Embodiment 4)

Figure 4:
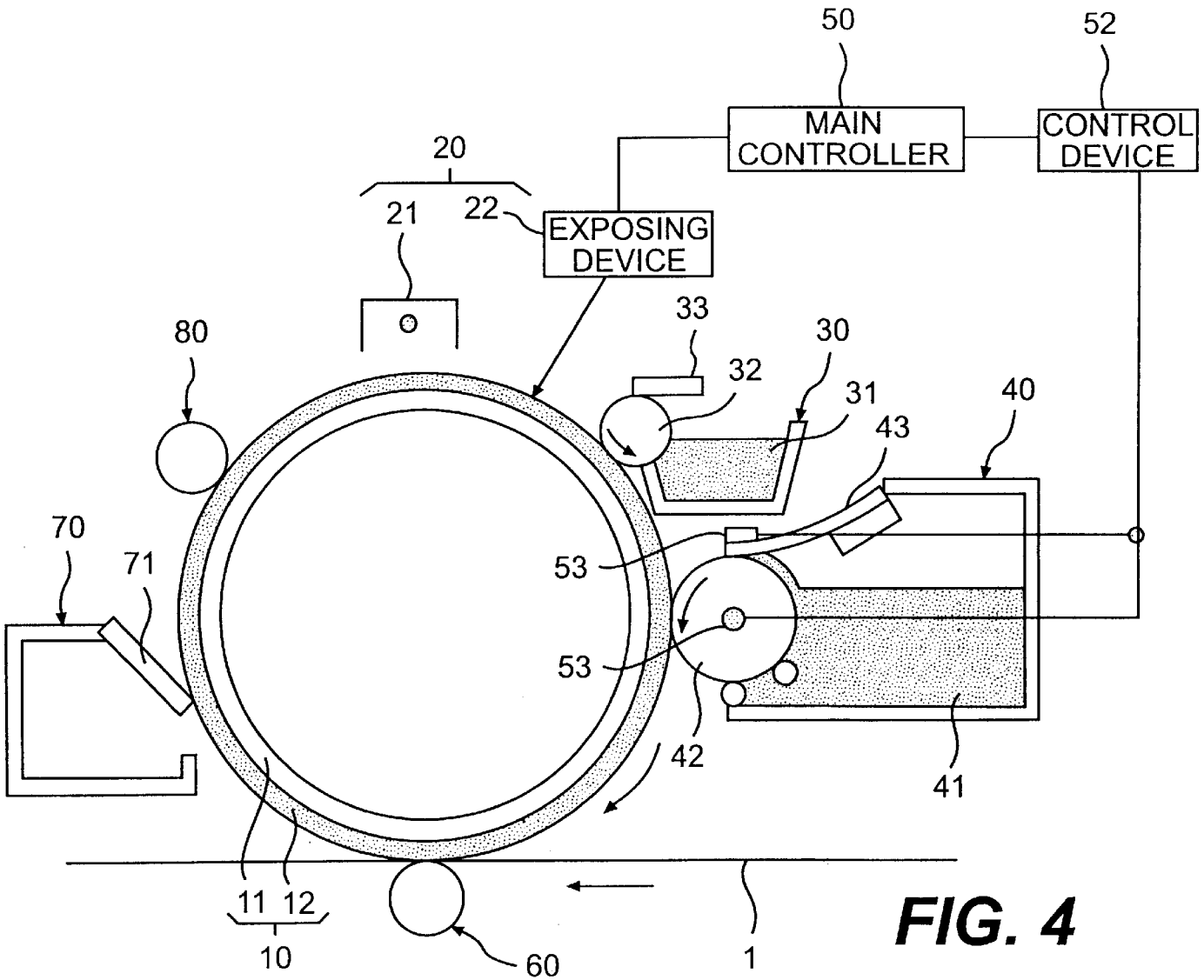
FIG. 4 is a schematic explanatory view showing an image forming apparatus according to an embodiment 4 of the present invention.

In an image forming apparatus according to an embodiment 4, an image carrying member 10 so constructed that a photosensitive layer 12 is formed on the surface of an electrically conductive member 11 is used, as shown in FIG. 4, and the image carrying member 10 is rotated, to an electrostatic latent image on the surface of the image carrying member 10 by a latent image forming device 20, as in the image forming apparatus according to the embodiment 1.

Also in the image forming apparatus according to the present embodiment 4, used as the latent image forming device 20 are a charger 21 for uniformly charging the surface of the image carrying member 10 and an exposing device 22 for subjecting the charged surface of the image carrying member 10 to exposure corresponding to image data fed from a main controller 50, as in the image forming apparatus according to the embodiment 1. The charged surface of the image carrying member 10 is subjected to exposure corresponding to the image data from the exposing device 22, to an electrostatic latent image on the surface of the image carrying member 10.

A non-conductive release agent 31 such as silicone oil is then applied so as to have a suitable thickness to the surface of the image carrying member 10 having the electrostatic latent image thus formed thereon from a release agent application device 30, as in the image forming apparatus according to the embodiment 1.

Ink 41 is supplied from an ink developing device 40 to the image carrying member 10 thus coated with the release agent 31. The ink 41 is applied to a portion, where the electrostatic latent image is formed, on the surface of the image carrying member 10, to form an ink image corresponding to the electrostatic latent image on the surface of the image carrying member 10.

In thus forming the ink image on the surface of the image carrying member 10 by the ink developing device 40, ink 41 whose viscosity is decreased as the temperature is raised. The ink 41 is contained in the ink developing device 40, and is held on the surface of an ink carrying member 42 in the shape of a rotating drum. The amount of the ink 41 held on the surface of the ink carrying member 42 is regulated by a regulating member 43, to make such adjustment that the ink held on the surface of an ink carrying member 42 has a predetermined thickness. The ink 41 thus held so as to have a predetermined thickness in the ink carrying member 42 is brought into contact with the surface of the image carrying member 10, to form an ink image corresponding to the electrostatic latent image formed on the surface of the image carrying member 10.

After the ink image is thus formed on the surface of the image carrying member 10, the ink image formed on the surface of the image carrying member 10 is transferred onto a recording medium 1 by a transfer roller 60, while the ink 41 remaining on the surface of the image carrying member 10 after the transfer is removed from the surface of the image carrying member 10 by a cleaning device 70 using a cleaning blade 71. Thereafter, charge remaining on the surface of the image carrying member 10 is eliminated by a charge eliminating device 80, and a new electrostatic latent image is formed again on the surface of the image carrying member 10 by the latent image forming device 20. The above-mentioned operations are repeated, to an image.

In the image forming apparatus according to the present embodiment 4, temperature adjusting devices 53 for adjusting the temperature of the ink 41 in the ink developing device 40 are respectively provided inside the ink carrying member 42 and on the regulating member 43. The temperature of the ink 41 in the ink developing device 40 is changed by the temperature adjusting devices 53, to adjust the viscosity of the ink 41 in the ink developing device 40.

Image data of the electrostatic latent image formed on the surface of the image carrying member 10 is fed to a control device 52 from the main controller 50 for feeding the image data to the exposing device 22 as described above, and the amount of the release agent 31 mixed with the ink 41 in the ink developing device 40 is detected by the control device 52. The temperature adjusting devices 53 are controlled by the control device 52 on the basis of the amount of the release agent 31 thus detected. The temperature of the ink 41 in the ink developing device 40 is changed by the temperature adjusting devices 53, to make such adjustment that the ink 41 has a suitable viscosity. For example, in a case where the viscosity of the ink 41 is decreased by the increase in the amount of the release agent 31 mixed with the ink 41, the temperature of the ink 41 in the ink developing device 40 is lowered by each of the temperature adjusting devices 53, to increase the viscosity of the ink 41. The viscosity of the ink 41 is thus maintained at a suitable value even when the release agent 31 is mixed with the ink 41.

When the viscosity of the ink 41 in the ink developing device 40 is thus suitably maintained, a time period elapsed until the ink 41 reaches a portion, where the electrostatic latent image is formed, on the surface of the image carrying member 10, for example, is fixed. Therefore, a good image which is not fogged is stably obtained.

A specific example using the image forming apparatus according to the embodiment 4 will be described.

In the example, in the above-mentioned image forming apparatus according to the embodiment 4, image data 5 percent of which is an image part for forming an electrostatic latent image was fed to the exposing device 22 from the main controller 50, to form an electrostatic latent image 5 percent of which is an image part on the surface of the image carrying member 10.

In this example, a release agent 31 having a specific gravity of 1 g/cm$^3$ and having a viscosity of 200 cP was applied so as to have a thickness of 0.5 $\mu$m to the surface of the image carrying member 10 having the electrostatic latent image thus formed thereon from the release agent application device 30.

Figure 5:
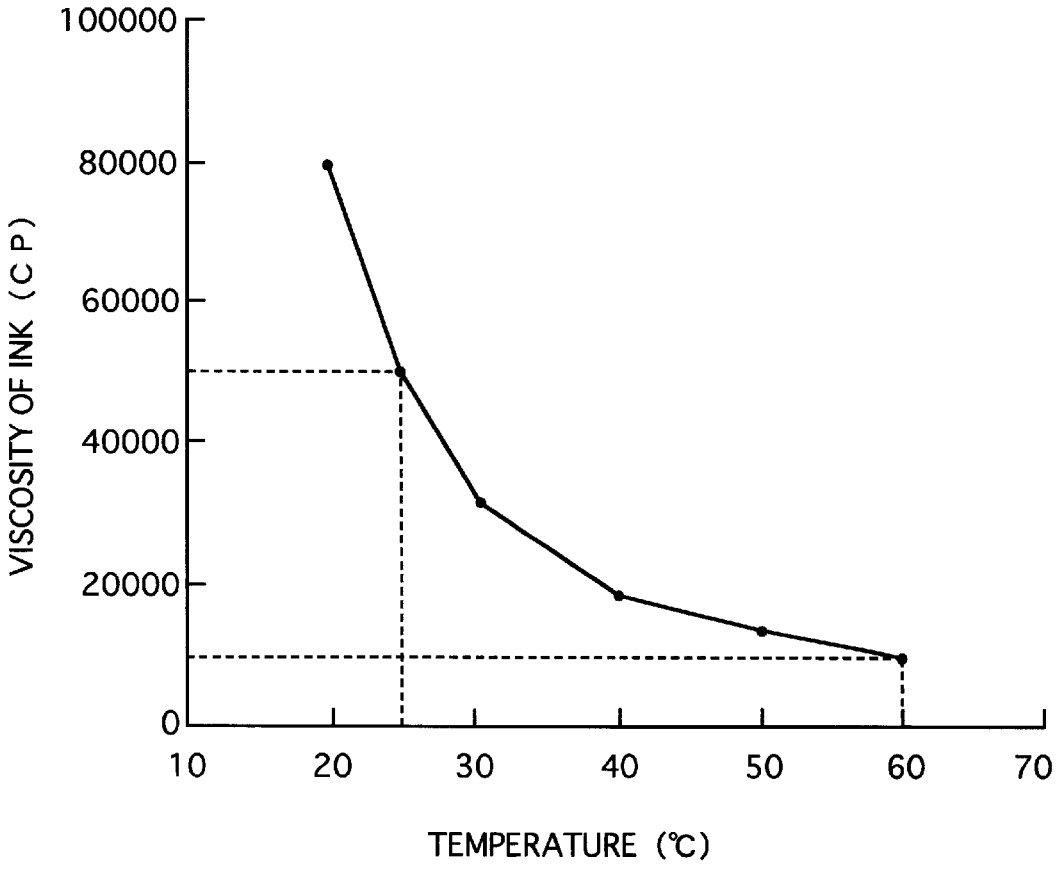
FIG. 5 is a diagram showing the relationship between a viscosity and temperature of ink used in an example using the image forming apparatus according to the embodiment 4.

In then supplying the ink 41 from the ink developing device 40 to the surface of the image carrying member 10 thus having the electrostatic latent image formed thereon and the release agent 31 applied thereto, to form an ink image corresponding to the electrostatic latent image on the surface of the image carrying member 10, ink 41 having a specific gravity of 1 g/cm$^3$ and having a viscosity which is changed, as shown in FIG. 5, with temperature changes was used. The viscosity of the ink 41 shown in FIG. 5 is a value measured at a shear rate of 50 sec$^{-1}$ under an environment at room temperature of 25° C. in which the image forming apparatus was employed.

The ink 41 was held so as to have a thickness of 10 $\mu$m on the surface of the ink carrying member 42, the ink 41 was brought into contact with the surface of the image carrying member 10 having the electrostatic latent image formed thereon and the release agent 31 applied thereto as described above. The ink 41 was supplied to a portion, where the electrostatic latent image is formed, on the surface of the image carrying member 10, to form an ink image corresponding to the electrostatic latent image on the surface of the image carrying member 10. The ink image thus formed was transferred onto the recording medium 1 by the transfer roller 50 as described above, to continuously form an image.

Figure 6:
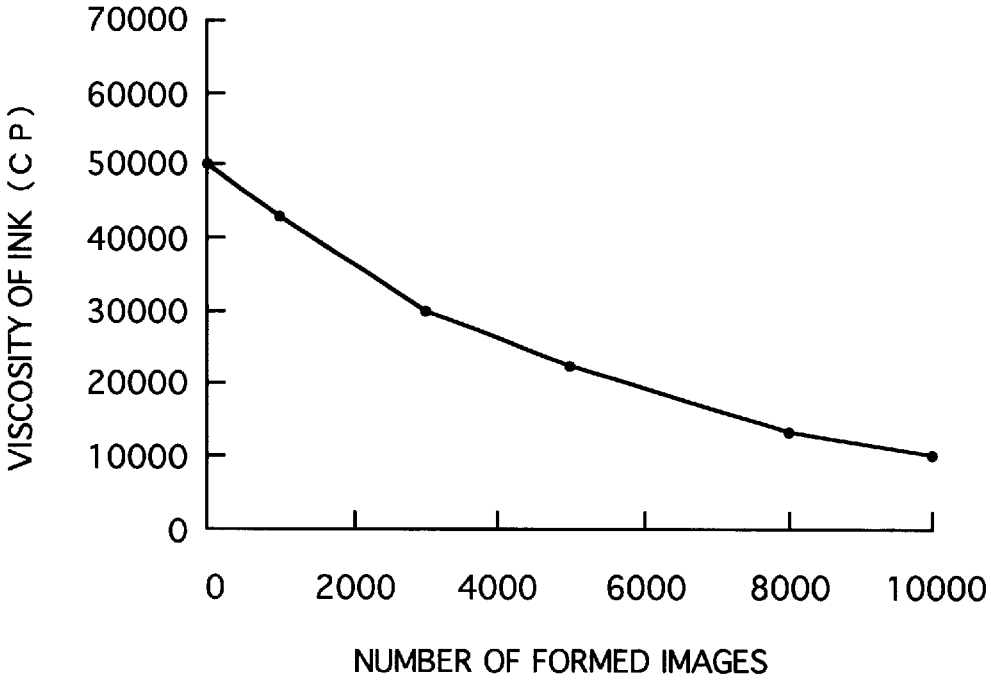
FIG. 6 is a diagram showing, in an example using the image forming apparatus according to the embodiment 4, the relationship between a viscosity of ink and a number of formed images in a case wherein an image is formed without changing temperature of the ink.

In thus forming the image, when the image was formed without changing the temperature of the ink 41 in the ink developing device 40, a part of the release agent 31 applied to the surface of the image carrying member 10 was mixed with the ink 41 in the ink developing device 40, so that the amount of the release agent 31 in the ink 41 was gradually increased. Therefore, the viscosity of the ink 41 in the ink developing device 40 was gradually decreased as the number of formed images was increased, as shown in FIG. 6. The viscosity of the ink 41 shown in FIG. 6 is a value measured at a shear rate of 50 $sec^{-1}$ under an environment at room temperature of 25° C. in which the image forming apparatus was employed, as in the above-mentioned case shown in FIG. 5.

In the present embodiment 4, the viscosity of the ink 41 suitable for image formation is 8000 to 12000 cP. At the beginning of the image formation, therefore, the temperature of the ink 41 in the ink developing device 40 was set to approximately 60° C. by the temperature adjusting devices 53.

When the release agent 31 is mixed with the ink 41 in the ink developing device 40 so that the viscosity of the ink 41 was decreased as the image is formed, the amount of the mixed release agent 31 was detected by the control device 52 on the basis of the image data of the electrostatic latent image fed from the controller 50, and the temperature adjusting devices 53 are controlled by the control device 52 on the basis of the detection.

In controlling the temperature adjusting devices 53 by the control device 52, the temperature of the ink 41 in the ink developing device 40 was gradually decreased by the temperature adjusting devices 53, to increase the viscosity of the ink 41. At the time point where 10000 images were formed, the temperature of the ink 41 in the ink developing device 40 was set to approximately 25° C. such that the viscosity of the ink 41 was in the range of 8000 to 12000 cP.

When the image was thus formed, the viscosity of the ink 41 in the ink developing device 40 was always in the range of 8000 to 12000 cP suitable for the image formation. Therefore, a good image which is not fogged was stably formed.

(Embodiment 5)

Figure 7:
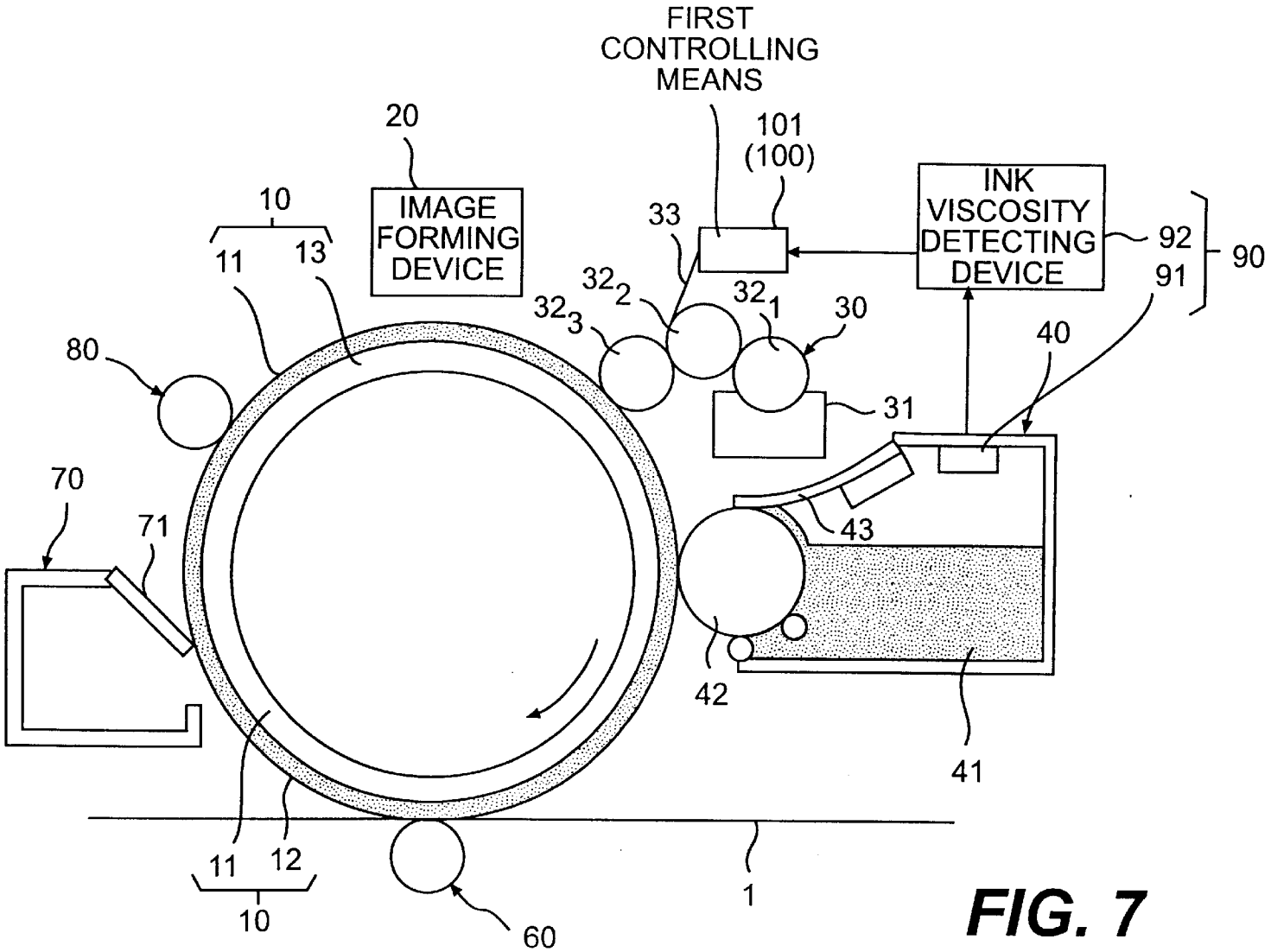
FIG. 7 is a schematic explanatory view showing an image forming apparatus according to an embodiment 5 of the present invention.

In an image forming apparatus according to an embodiment 5, an image carrying member 10 so constructed that a dielectric layer 13 is formed on the surface of an electrically conductive member 11 is used, as in the above-mentioned image forming apparatus according to the embodiment 2, as shown in FIG. 7. The image carrying member 10 is rotated at a suitable system speed, to an electrostatic latent image on the surface of the image carrying member 10 by a latent image forming device 20.

Used as the latent image forming device 20 is a latent image forming device 20 such as an electrostatic head of an ion flow type, as in the above-mentioned embodiment 2. The surface of the image carrying member 10 is selectively charged by the latent image forming device 20 on the basis of image data of the electrostatic latent image fed from a main controller 50, to form the electrostatic latent image.

A non-conductive release agent 31 is then applied to the surface of the image carrying member 10 having the electrostatic latent image thus formed thereon from a release agent application device 30.

In applying the non-conductive release agent 31 to the surface of the image carrying member 10 by the release agent application device 30, silicone oil, for example, is used as the release agent 31 in the present embodiment 5. A part of a first roller $\mathbf{32}_1$ is dipped in the release agent application device 30 containing the release agent 31, to hold the release agent 31 on the surface of the first roller $\mathbf{32}_1$. The release agent 31 held on the surface of the first roller $\mathbf{32}_1$ is successively introduced into second and third rollers $\mathbf{32}_2$ and $\mathbf{32}_3$, and the amount of the release agent 31 held on the surface of the second roller $\mathbf{32}_2$ is regulated by a blade 33. The release agent 31 having a predetermined thickness is introduced into the image carrying member 10 by the third roller $\mathbf{32}_3$, to apply the release agent 31 to the surface of the image carrying member 10 so as to have a suitable thickness.

Ink 41 is supplied from an ink developing device 40 to the image carrying member 10 thus coated with the release agent 31. The ink 41 is applied to a portion, where the electrostatic latent image is formed, on the surface of the image carrying member 10, to form an ink image on the surface of the image carrying member 10.

In thus forming the ink image on the surface of the image carrying member 10 by the ink developing device 40, the ink 41 contained in the ink developing device 40 is held on the surface of an ink carrying member 42 in a drum shape, and the amount of the ink 41 held on the surface of the ink carrying member 42 is regulated by a regulating member 43 such that the ink 41 held on the surface of the ink carrying member 42 has a predetermined thickness.

The ink 41 held on the surface of the ink carrying member 42 is brought into contact with the surface of the image carrying member 10 and is applied to the portion, where the electrostatic latent image is formed, on the surface of the image carrying member 10, to form an ink image corresponding to the electrostatic latent image on the surface of the image carrying member 10.

After the ink image is thus formed on the surface of the image carrying member 10, the ink image formed on the surface of the image carrying member 10 is transferred onto a recording medium 1 by a transfer roller 60, while the ink 41 remaining on the surface of the image carrying member 10 after the transfer is removed from the surface of the image carrying member 10 by a cleaning device 70 using a cleaning blade 71. Thereafter, charge remaining on the surface of the image carrying member 10 is eliminated by a charge eliminating device 80, and a new electrostatic latent image is formed again on the surface of the image carrying member 10 by the latent image forming device 20. The above-mentioned operations are repeated, to an image.

In the image forming apparatus according to the present embodiment 5, when environmental conditions under which the image forming apparatus is employed are changed in forming the image in the above-mentioned manner, the change is detected by detecting means 90. A time period elapsed until the ink 41 reaches the surface of the image carrying member 10 having the electrostatic latent image formed thereon through the release agent 31 depending on the change in the environmental conditions detected by the detecting means 90 is controlled by first controlling means 100.

In detecting the change in the environmental conditions under which the image forming apparatus is employed by the detecting means 90, a temperature sensor 91 for detecting the temperature of the ink 41 contained in the ink developing device 40 is provided in the present embodiment 5. The change in the viscosity of the ink 41 is detected by an ink viscosity detecting device 92 on the basis of the temperature measured by the temperature sensor 91.

The values of the viscosity of the ink 4 corresponding to the temperature of the ink 41 are previously stored as a table in the ink viscosity detecting device 92, to detect the viscosity of the ink 41 corresponding to the temperature of the ink 41 measured by the temperature sensor 91.

When the change in the viscosity of the ink 41 is detected by the ink viscosity detecting device 92, in controlling a time period elapsed until the ink 41 reaches the surface of the image carrying member having the electrostatic latent image formed thereon through the release agent 31 by the first controlling means 100, the contact pressure of the blade 33 for regulating the amount of the release agent 31 held on the surface of the roller 32 is controlled by a blade control device 101 on the basis of the detected viscosity of the ink 41, to adjust the thickness of the release agent 31 applied to the surface of the image carrying member 10.

The values of the thickness of the release agent 31 corresponding to the viscosity of the ink 41 are previously stored as a table in the first controlling means 100 such that the time period elapsed until the ink 41 reaches the surface of the image carrying member 10 having the electrostatic latent image formed thereon through the release agent 31 is fixed even if the viscosity of the ink 41 is changed. The first controlling means 100 controls the blade control device 101 such that the release agent 31 is applied to the surface of the image carrying member 10 so as to have a suitable thickness corresponding to the viscosity of the ink 41 detected by the ink viscosity detecting device 92.

When the viscosity of the ink 41 detected by the ink viscosity detecting device 92 is decreased by the rise in the temperature of the ink 41 measured by the temperature sensor 91, the time period elapsed until the ink 41 reaches the surface of the image carrying member 10 having the electrostatic latent image formed thereon through the release agent 31 is shortened. In this case, therefore, the thickness of the release agent 31 applied to the surface of the image carrying member 10 is increased by the blade control device 101, thereby preventing the ink 41 from adhering to a portion, where no electrostatic latent image is formed, of the image carrying member 10.

On the other hand, when the viscosity of the ink 41 detected by the ink viscosity detecting device 92 is increased by the drop in the temperature of the ink 41 measured by the temperature sensor 91, the time period elapsed until the ink 41 reaches the surface of the image carrying member 10 having the electrostatic latent image formed thereon through the release agent 31 is lengthened. In this case, therefore, the thickness of the release agent 31 applied to the surface of the image carrying member 10 is decreased by the blade control device 101, to make the ink 41 sufficiently adhere to a portion, where the electrostatic latent image is formed, of the image carrying member 10.

Even when the temperature and the viscosity of the ink 41 are changed by the change in the environmental conditions under which the image forming apparatus is employed, therefore, a good image which has a sufficient image density and is not fogged is obtained.

In the above-mentioned release agent application device 30, a plurality of rollers for enlargement may be further provided between the second roller $\mathbf{32}_2$ regulated by the blade 33 and the third roller $\mathbf{33}_3$ for applying the release agent 31 to the image carrying member 10. When the rollers for enlargement are arranged, it is possible to make the thickness of the release agent 31 applied to the surface of the image carrying member 10 more uniform.

The blade 33 may be also arranged on the first roller $\mathbf{32}_1$ a part of which is dipped in the release agent 31, to regulate the amount of the release agent 31. Even if a plurality of rollers in which the amount of the release agent 31 is regulated by the blade 33 are arranged, to gradually decrease the amount of the release agent 31 to a desired amount, it is possible to make the thickness of the release agent 31 applied to the image carrying member 10 more uniform.

(Embodiment 6)

Figure 8:
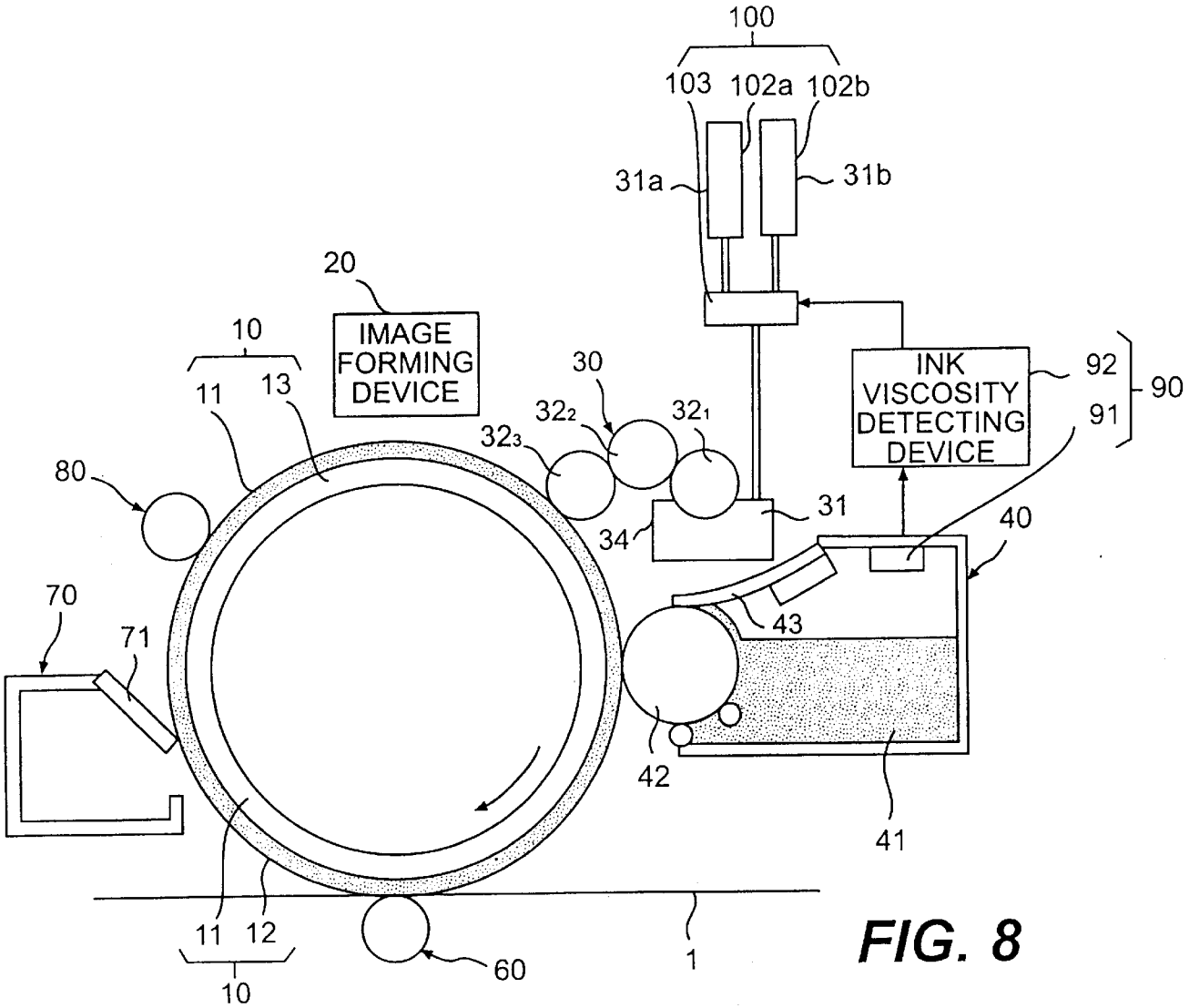
FIG. 8 is a schematic explanatory view showing an image forming apparatus according to am embodiment 6 of the present invention.

Also in an image forming apparatus according to an embodiment 6, an image is formed in the same manner as that in the above-mentioned image forming apparatus according to the embodiment 5, as shown in FIG. 8.

In detecting, when environmental conditions under which the image forming apparatus is employed are changed, the change by detecting means 90, the temperature of ink 41 contained in an ink developing device 40 is measured by a temperature sensor 91, to detect the viscosity of the ink 41 by an ink viscosity detecting device 92 on the basis of the measurement, as in the image forming apparatus according to the embodiment 5.

The image forming apparatus according to the present embodiment 6 differs from the image forming apparatus according to the embodiment 5 only in a method of controlling a time period elapsed until the ink 41 reaches the surface of an image carrying member 10 having an electrostatic latent image formed thereon through a release agent 31 by first controlling means 100.

In the image forming apparatus according to the present embodiment 6, in supplying the release agent 31 to a containing chamber 34 in a release agent application device 30, there are provided a first tank 102*a* containing a release agent 31*a* having a high viscosity and a second tank 102*b* containing a release agent 31*b* having a low viscosity. The release agents 31*a* and 31*b* supplied to the containing chamber 34 are changed by a supply control device 103, to adjust the viscosity of the release agent 31 applied to the surface of the image carrying member 10.

The values of the viscosity of the release agent 31 corresponding to the viscosity of the ink 41 are previously stored as a table in the supply control device 103 such that the time period elapsed until the ink 41 reaches the surface of the image carrying member 10 having the electrostatic latent image formed thereon through the release agent 31 is fixed even if the viscosity of the ink 41 is changed. The supply control device 103 changes the release agent 31 supplied to the containing chamber 34 such that the release agent 31 having a viscosity corresponding to the viscosity of the ink 41 detected by the ink viscosity detecting device 92 is applied to the image carrying member 10.

When the viscosity of the ink 41 detected by the ink viscosity detecting device 92 is decreased by the rise in the temperature of the ink 41 measured by the temperature sensor 91, the time period elapsed until the ink 41 reaches the surface of the image carrying member 10 having the electrostatic latent image formed thereon through the release agent 31 is shortened. In this case, therefore, the viscosity of the release agent 31 applied to the surface of the image carrying member 10 is increased, thereby preventing the ink 41 from adhering to a portion, where no electrostatic latent image is formed, of the image carrying member 10.

On the other hand, when the viscosity of the ink 41 detected by the ink viscosity detecting device 92 is increased by the drop in the temperature of the ink 41 measured by the temperature sensor 91, the time period elapsed until the ink 41 reaches the surface of the image carrying member 10 having the electrostatic latent image formed thereon through the release agent 31 is lengthened. In this case, therefore, the viscosity of the release agent 31 applied to the surface of the image carrying member 10 is decreased, to make the ink 41 sufficiently adhere to a portion, where the electrostatic latent image is formed, of the image carrying member 10.

Even when the temperature and the viscosity of the ink 41 are changed with the change in the environmental conditions under which the image forming apparatus is employed, therefore, a good image which has a sufficient image density and is not fogged is obtained.

(Embodiment 7)

Figure 9:
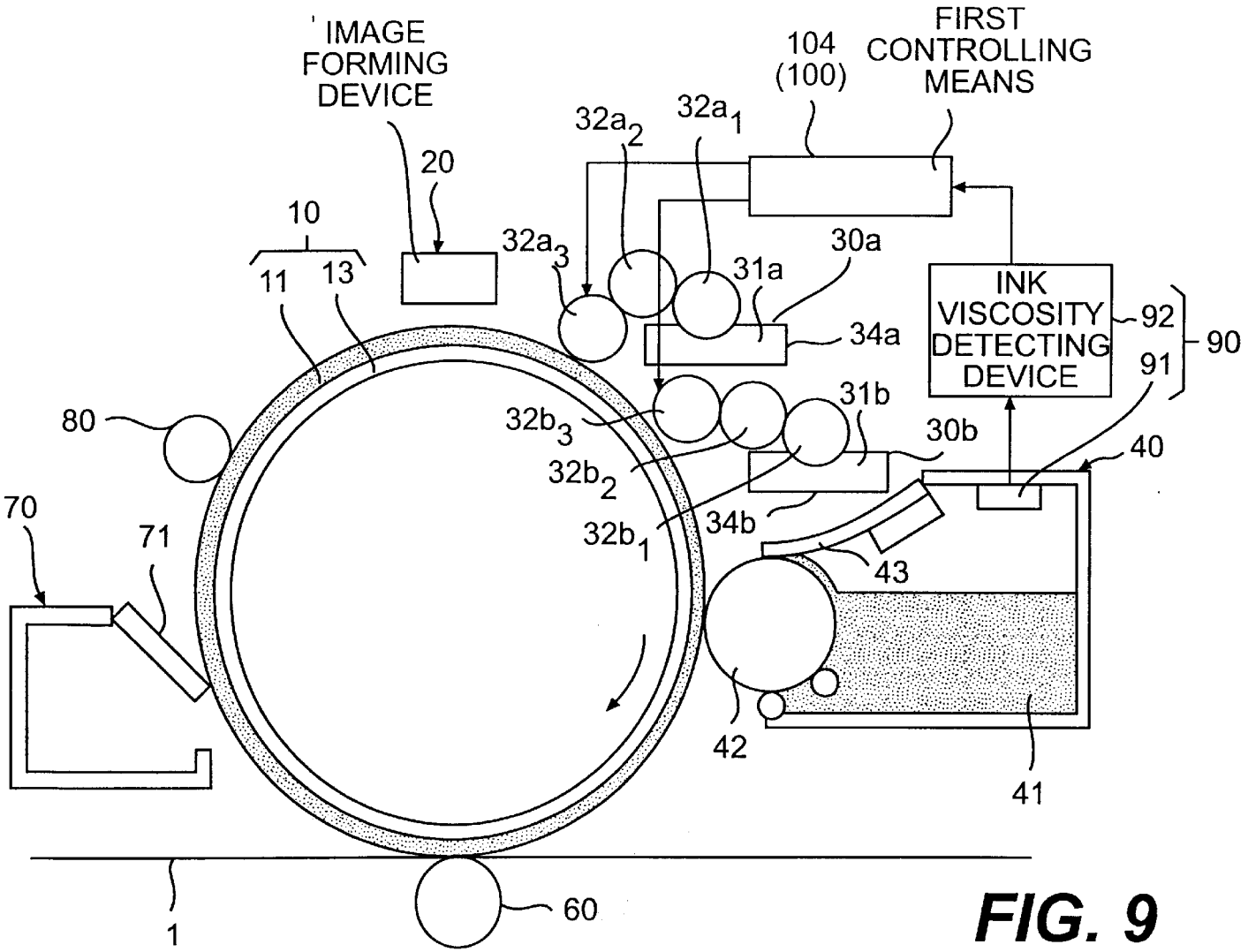
FIG. 9 is a schematic explanatory view showing an image forming apparatus according to an embodiment 7 of the present invention.

Also in an image forming apparatus according to an embodiment 7, an image is formed in the same manner as those in the above-mentioned image forming apparatuses according to the embodiments 5 and 6, as shown in FIG. 9.

In detecting, when the environmental conditions under which the image forming apparatus is employed are changed, the change by detecting means 90, the temperature of ink 41 contained in an ink developing device 40 is measured by a temperature sensor 91, to detect the viscosity of the ink 41 by an ink viscosity detecting device 92 on the basis of the measurement, as in the image forming apparatuses according to the embodiments 5 and 6.

The image forming apparatus according to the present embodiment 7 differs from the image forming apparatuses according to the embodiments 5 and 6 only in a method of controlling a time period elapsed until the ink 41 reaches the surface of an image carrying member 10 having an electrostatic latent image formed thereon through a release agent 31 by first controlling means 100.

In the image forming apparatus according to the embodiment 7, provided as the above-mentioned release agent application device 30 are a first application device 30*a* for applying a release agent 31*a* having a high viscosity to the surface of the image carrying member 10 by first to third rollers $\mathbf{32}a_1$ to $\mathbf{32}a_3$ with the release agent 31*a* contained in a containing chamber 34*a*, and a second application device 30*b* for applying a release agent 31*b* having a low viscosity to the surface of the image carrying member 10 by first to third rollers $\mathbf{32}b_1$ to $\mathbf{32}b_3$ with the release agent 31*b* contained in a containing chamber 34*b*.

In the image forming apparatus according to the present embodiment 7, in controlling a time period elapsed until the ink 41 reaches the surface of the image carrying member 10 having the electrostatic latent image formed thereon through the release agent 31 by the first controlling means 100, the first application device 30*a* and the second application device 30*b* are switched by a switching device 104, to change the types of the release agents 31*a* and 31*b* applied to the surface of the image carrying member 10.

The switching device 104 previously stores as a table the values of the viscosity of the release agent 31 corresponding to the viscosity of the ink 41 such that the time period elapsed until the ink 41 reaches the surface of the image carrying member 10 having the electrostatic latent image formed thereon through the release agent 31 is fixed even if the viscosity of the ink 41 is changed.

The switching device 104 switches the first application device 30*a* and the second application device 30*b* such that the release agent 31 having a viscosity corresponding to the viscosity of the ink 41 detected by the ink viscosity detecting device 92 is applied to the surface of the image carrying member 10.

When the viscosity of the ink 41 detected by the ink viscosity detecting device 92 is decreased by the rise in the temperature of the ink 41 measured by the temperature sensor 91, the time period elapsed until the ink 41 reaches the surface of the image carrying member 10 having the electrostatic latent image formed thereon through the release agent 31 is shortened. Accordingly, the release agent 31*a* having a high viscosity is applied to the surface of the image carrying member 10 from the first application device 30*a* by the switching device 104, thereby preventing the ink 41 from adhering to a portion, where no electrostatic latent image is formed, of the image carrying member 10.

On the other hand, when the viscosity of the ink 41 detected by the ink viscosity detecting device 92 is increased by the drop in the temperature of the ink 41 measured by the temperature sensor 91, the time period elapsed until the ink 41 reaches the surface of the image carrying member 10 having the electrostatic latent image formed thereon through the release agent 31 is lengthened. Accordingly, the release agent 31 having a low viscosity is applied to the surface of the image carrying member 10 from the second application device 30*b* by the switching device 104, to make the ink 41 sufficiently adhere to a portion, where the electrostatic latent image is formed, of the image carrying member 10.

Even when the temperature and the viscosity of the ink 41 are changed by the change in the environmental conditions under which the image forming apparatus is employed, therefore, a good image which has a sufficient image density and is not fogged is obtained, as in the image forming apparatuses according to the embodiments 5 and 6.

(Embodiment 8)

Figure 10:
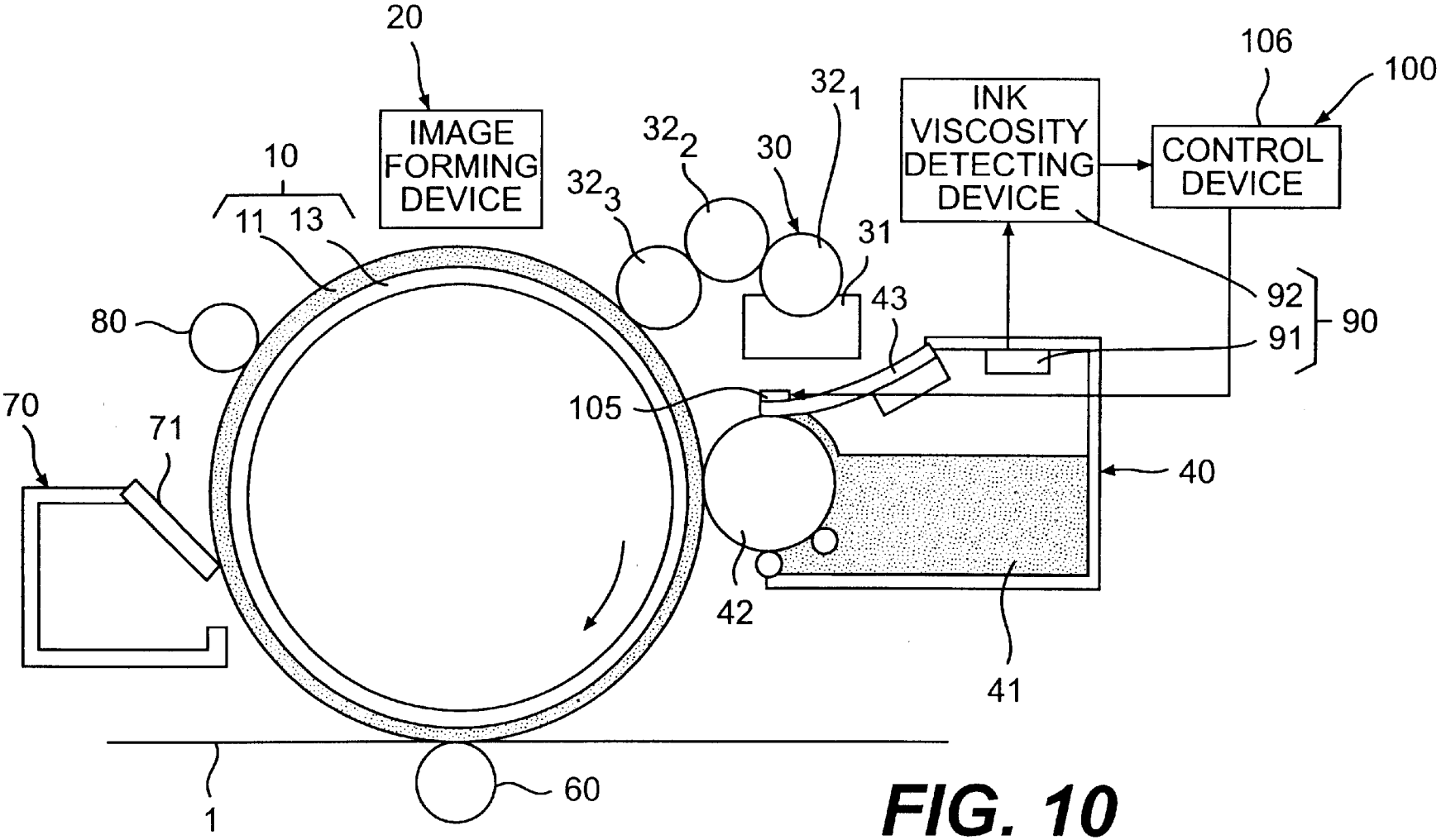
FIG. 10 is a schematic explanatory view showing an image forming apparatus according to an embodiment 8 of the present invention.

Also in an image forming apparatus according to an embodiment 8, an image is formed in the same manner as those in the above-mentioned image forming apparatuses according to the embodiments 5 to 7, as shown in FIG. 10.

In detecting, when environmental conditions under which the image forming apparatus is employed are changed, the change by detecting means 90, the temperature of ink 41 contained in an ink developing device 40 is measured by a temperature sensor 91, to detect the viscosity of the ink 41 by an ink viscosity detecting device 92 on the basis of the measurement, as in the image forming apparatuses according to the embodiments 5 to 7.

The image forming apparatus according to the present embodiment 8 differs from the image forming apparatuses according to the embodiments 5 to 7 only in a method of controlling a time period elapsed until the ink 41 reaches the surface of an image carrying member 10 having an electrostatic latent image formed thereon through a release agent 31 by first controlling means 100.

In the image forming apparatus according to the present embodiment 8, in controlling the time period elapsed until the ink 41 reaches the surface of the image carrying member 10 having the electrostatic latent image formed thereon through the release agent 31 by the first controlling means 100, there are provided a temperature adjusting device 105 for adjusting the temperature of the ink 41 on a regulating member 43 for regulating the amount of the ink 41 held on the surface of an ink carrying member 42 in the ink developing device 40, and a control device 106 for controlling the temperature of the ink 41 by the temperature adjusting device 105.

The temperature adjusting device 105 is controlled by the control device 106 on the basis of the viscosity of the ink 41 detected by an ink viscosity detecting device 92.

The control device 106 previously stores as a table the values of the temperature of the ink 41 corresponding to the viscosity of the ink 41. The control device 106 adjusts, in correspondence with the viscosity of the ink 41 detected by the ink viscosity detecting device 92, the temperature of the ink 41 by the temperature adjusting device 105, to control the viscosity of the ink 41 such that the viscosity of the ink 41 is kept constant.

When the viscosity of the ink 41 detected by the ink viscosity detecting device 92 is decreased by the rise in the temperature of the ink 41 in the ink developing device 40 measured by the temperature sensor 91, the temperature of the ink 41 introduced into the surface of the image carrying member 10 is lowered by the temperature adjusting device 105 on the basis of the control device 106 such that the viscosity of the ink 41 introduced into the surface of the image carrying member 10 is kept constant.

On the other hand, when the viscosity of the ink 41 detected by the ink viscosity detecting device 92 is increased by the drop in the temperature of the ink 41 in the ink developing device 40 measured by the temperature sensor 91, the temperature of the ink 41 introduced into the surface of the image carrying member 10 is raised by the temperature adjusting device 105 on the basis of the control device 106 such that the viscosity of the ink 41 introduced into the surface of the image carrying member 10 is kept constant.

Even when the temperature and the viscosity of the ink 41 in the ink developing device are changed by the change in the environmental conditions under which the image forming apparatus is employed, therefore, the viscosity of the ink 41 introduced into the surface of the image carrying member 10 is kept constant. Therefore, a good image which has a sufficient image density and is not fogged is obtained, as in the image forming apparatuses according to the embodiments 5 to 7.

(Embodiment 9)

Figure 11:
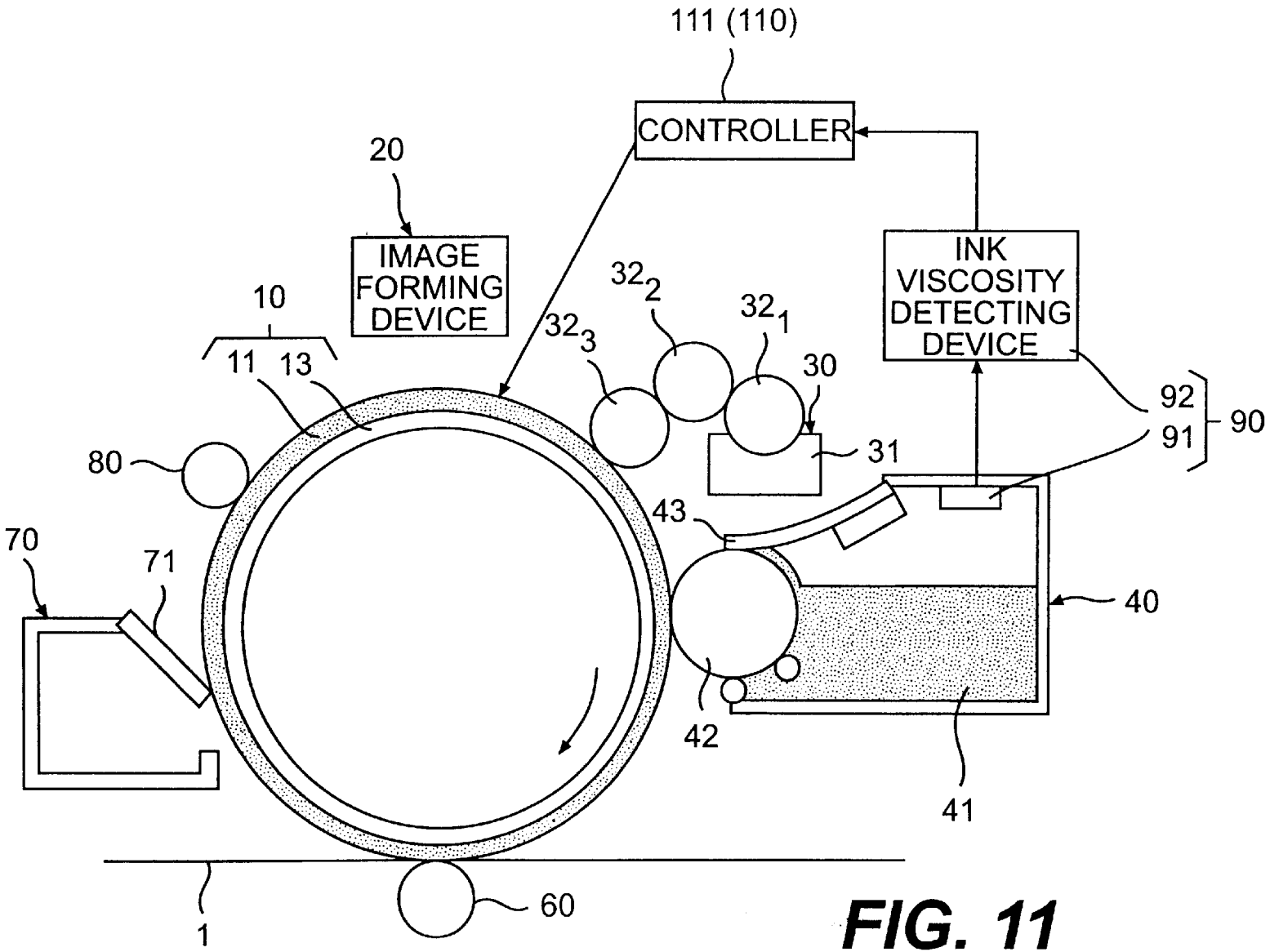
FIG. 11 is a schematic explanatory view showing an image forming apparatus according to an embodiment 9 of the present invention.

Also in an image forming apparatus according to an embodiment 9, an image is formed in the same manner as those in the above-mentioned image forming apparatuses according to the embodiments 5 to 8, as shown in FIG. 11.

In detecting, when environmental conditions under which the image forming apparatus is employed are changed, the change by detecting means 90, the temperature of ink 41 contained in an ink developing device 40 is measured by a temperature sensor 91, to detect the viscosity of the ink 41 by an ink viscosity detecting device 92 on the basis of the measurement, as in the image forming apparatuses according to the embodiments 5 to 8.

In the image forming apparatus according to the present embodiment 9, even when the environmental conditions under which the image forming apparatus is employed are changed, a time period elapsed from the time when the ink 41 in the ink developing device 40 is brought into contact with the surface of an image carrying member 10 coated with a release agent 31 until it is separated therefrom (hereinafter referred to as developing nip passage time) is controlled by second controlling means 110.

In the image forming apparatus according to the present embodiment 9, in controlling the time period elapsed from the time when the ink 41 in the ink developing device 40 is brought into contact with the surface of the image carrying member 10 coated with the release agent 31 until it is separated therefrom by the second controlling means 110, the viscosity of the ink 41 detected by the ink viscosity detecting device 92 is transmitted to a controller 111 for controlling the rotational speed of the image carrying member 10.

The controller 111 previously stores as a table the values of the rotational speed of the image carrying member 10 corresponding to the viscosity of the ink 41 such that a time period elapsed until the ink 41 reaches the surface of the image carrying member 10 having an electrostatic latent image formed thereon through the release agent 31 is fixed even if the viscosity of the ink 41 is changed. The controller 111 adjusts the rotational speed of the image carrying member 10 so as to correspond to the viscosity of the ink 41 detected by the ink viscosity detecting device 92, to control the above-mentioned developing nip passage time.

When the viscosity of the ink 41 detected by the ink viscosity detecting device 92 is decreased by the rise in the temperature of the ink 41 measured by the temperature sensor 91, the time period elapsed until the ink 41 reaches the surface of the image carrying member 10 having the electrostatic latent image formed thereon through the release agent 31 is shortened. Accordingly, the rotational speed of the image carrying member 10 is increased by the controller 111, thereby preventing the ink 41 from adhering to a portion, where no electrostatic latent image is formed, of the image carrying member 10.

On the other hand, when the viscosity of the ink 41 detected by the ink viscosity detecting device 92 is increased by the drop in the temperature of the ink 41 measured by the temperature sensor 91, the time period elapsed until the ink 41 reaches the surface of the image carrying member 10 having the electrostatic latent image formed thereon through the release agent 31 is lengthened. Accordingly, the rotational speed of the image carrying member 10 is decreased by the controller 111, to make the ink 41 sufficiently adhere to a portion, where the electrostatic latent image is formed, of the image carrying member 10.

Even when the temperature and the viscosity of the ink 41 are changed by the change in the environmental conditions under which the image forming apparatus is employed, therefore, a good image which has a sufficient image density and is not fogged is obtained, as in the image forming apparatuses according to the embodiments 5 to 8.

(Embodiment 10)

Figure 12:
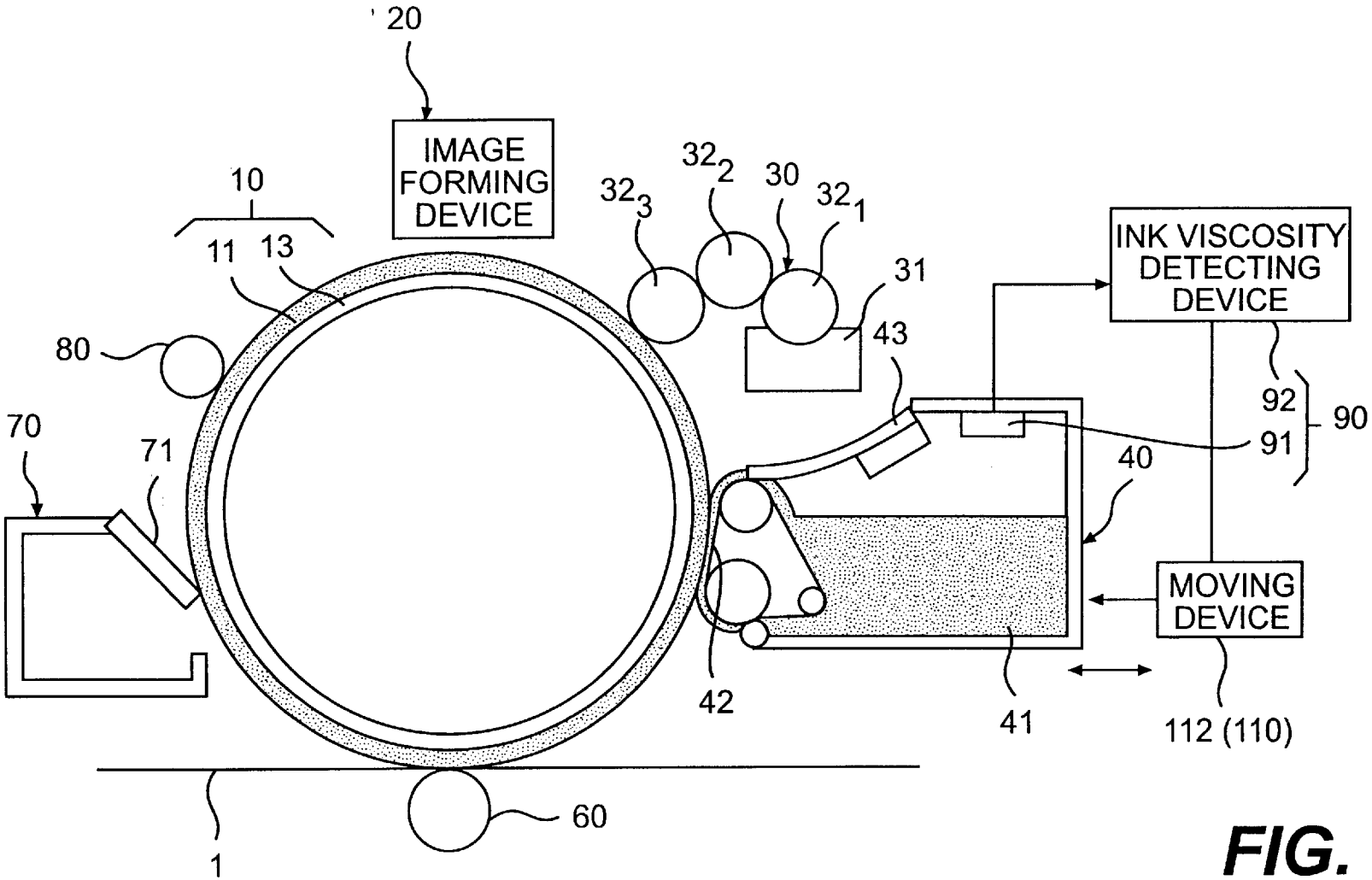
FIG. 12 is a schematic explanatory view showing an image forming apparatus according to an embodiment 10 of the present invention.

Also in an image forming apparatus according to an embodiment 10, an electrostatic latent image is formed on the surface of an image carrying member 10, and a non-conductive release agent 31 is applied to the surface of the image carrying member 10 having the electrostatic latent image formed thereon, as in the above-mentioned image forming apparatuses according to the embodiments 5 to 9, as shown in FIG. 12.

In the image forming apparatus according to the present embodiment 10, in supplying ink 41 from an ink developing device 40 to the surface of the image carrying member 10 having the electrostatic latent image formed thereon and the release agent 31 applied thereto as described above, to form an ink image corresponding to the electrostatic latent image on the surface of the image carrying member 10, the ink 41 is held on the surface of an ink carrying member 42 in a belt shape, and the ink 41 held on the ink carrying member 42 in a belt shape is brought into contact with the surface of the image carrying member 10 and is applied to a portion, where the electrostatic latent image is formed, on the surface of the image carrying member 10, to form the ink image corresponding to the electrostatic latent image on the surface of the image carrying member 10.

Thereafter, the ink image formed on the surface of the image carrying member is transferred onto a recording medium 1 by a transfer roller 60, as in the image forming apparatuses according to the embodiments 5 to 9. After the ink image is transferred onto the recording medium 1, the ink 41 remaining on the surface of the image carrying member 10 after the transfer is removed from the surface of the image carrying member 10 by a cleaning device 70 using a cleaning blade 71. Thereafter, charge remaining on the surface of the image carrying member 10 is eliminated by a charge eliminating device 80.

Also in the image forming apparatus according to the present embodiment 10, in detecting the change in environmental conditions under which the image forming apparatus is employed by detecting means 90, the temperature of ink 41 contained in the ink developing device 40 is measured by a temperature sensor 91, and the viscosity of the ink 41 is detected by an ink viscosity detecting device 92 on the basis of the measurement, as in the image forming apparatuses according to the embodiments 5 to 9.

In the image forming apparatus according to the present embodiment 10, in controlling a time period elapsed from the time when the ink 41 in the ink developing device 40 is brought into contact with the surface of the image carrying member 10 coated with the release agent 31 until it is separated therefrom by second controlling means 110 when the environmental conditions under which the image forming apparatus is employed are changed, there is provided a moving device 112 for moving the ink developing device 40 nearer to and away from the image carrying member 10. The ink developing device 40 is moved by the moving device 112, to adjust the distance (the nip width) from the point where the ink 41 held in the ink carrying member 42 in a belt shape is brought into contact with the surface of the image carrying member 10 to the point where it is separated therefrom. Although in the present embodiment 10, the ink developing device 40 is moved nearer to and away from the image carrying member 10 by the moving device 112, only the ink carrying member 42 in a belt shape can be moved nearer to and away from the image carrying member 10.

The second controlling means 110 previously stores as a table the values of the nip width corresponding to the viscosity of the ink 41 such that a time period elapsed until the ink 41 reaches the surface of the image carrying member 10 having the electrostatic latent image formed thereon through the release agent 31 is fixed even if the viscosity of the ink 41 is changed.

The second controlling means 110 moves the ink developing device 40 by the moving device 112 to control the nip width in correspondence with the viscosity of the ink 41 detected by the ink viscosity detecting device 92.

When the viscosity of the ink 41 detected by the ink viscosity detecting device 92 is decreased by the rise in the temperature of the ink 41 measured by the temperature sensor 91, the time period elapsed until the ink 41 reaches the surface of the image carrying member 10 having the electrostatic latent image formed thereon through the release agent 31 is shortened. Accordingly, the ink developing device 40 is moved in the direction away from the image carrying member 10 by the moving device 112, to narrow the nip width from the point where the ink 41 held in the ink carrying member 42 is brought into contact with the surface of the image carrying member 10 to the point where it is separated therefrom, thereby preventing the ink 41 from adhering to a portion, where no electrostatic latent image is formed, of the image carrying member 10.

On the other hand, when the viscosity of the ink 41 detected by the ink viscosity detecting device 92 is increased by the drop in the temperature of the ink 41 measured by the temperature sensor 91, the time period elapsed until the ink 41 reaches the surface of the image carrying member 10 having the electrostatic latent image formed thereon through the release agent 31 is lengthened. Accordingly, the ink developing device 40 is moved in the direction nearer to the image carrying member 10 by the moving device 112, to expand the nip width from the point where the ink 41 is brought into contact with the surface of the image carrying member 10 to the point where it is separated therefrom, thereby making the ink 41 sufficiently adhere to a portion, where the electrostatic latent image is formed, of the image carrying member 10.

Even when the temperature and the viscosity of the ink 41 are changed by the change in the environmental conditions under which the image forming apparatus is employed, therefore, a good image which has a sufficient image density and is not fogged is obtained, as in the image forming apparatuses according to the embodiments 5 to 9.

Figure 13:
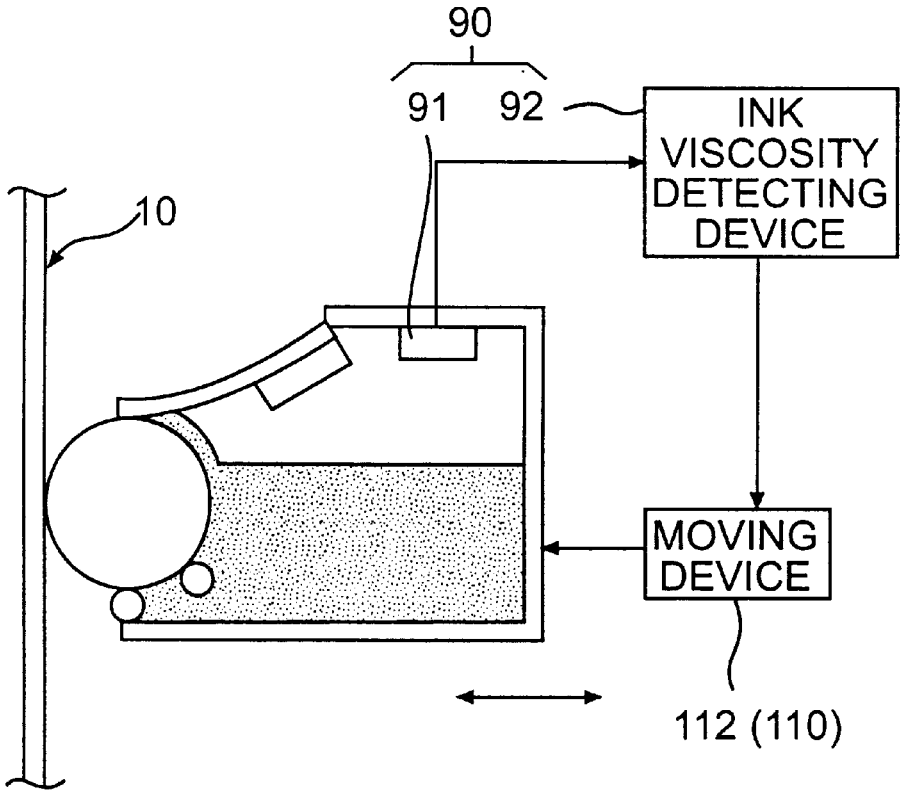
FIG. 13 is a partially explanatory view showing a modified example of the image forming apparatus according to the embodiment 10.

Although in the image forming apparatus according to the present embodiment 10, the ink developing device 40 is moved nearer to and away from the image carrying member 10 by the moving device 112 using as the ink carrying member 42 in the ink developing device 40 one in a belt shape, to adjust the nip width from the point where the ink 41 held in the ink carrying member 42 in a belt shape is brought into contact with the surface of the image carrying member 10 to the point where it is separated therefrom, the ink developing device 40 can be moved nearer to and away from the image carrying member 10 by the moving device 112 as described above using as the ink carrying member 42 in the ink developing device 40 one in a drum shape, as in the embodiments 5 to 9, while using as the image carrying member 10 one in a belt shape, as shown in FIG. 13, to adjust the nip width from the point where the ink 41 held in the ink carrying member 42 in a drum shape is brought into contact with the surface of the image carrying member 10 in a belt shape to the point where it is separated therefrom.

In cases where the ink carrying member 42 in a belt shape and the image carrying member 10 in a belt shape are used, as described above, the ink carrying member 42 and the image carrying member 10 can be brought into contact with each other under low and uniform pressure, thereby making it possible to prevent the density from being non-uniform as well as to use ink 41 having a high viscosity. Consequently, the allowable width for the ink 41 is expanded.

Figure 14:
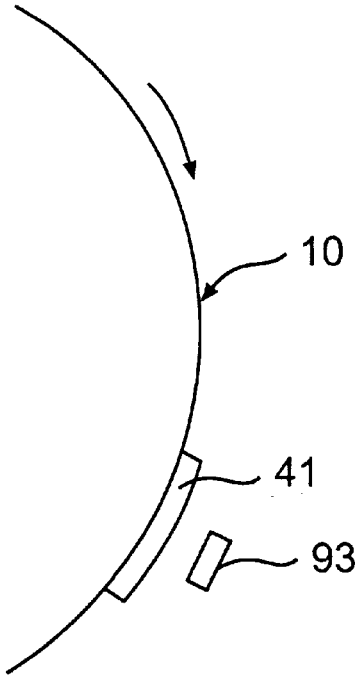
FIG. 14 is a partially explanatory view showing a modified example of detecting means in each of the image forming apparatuses according to the embodiments 5 to 10.

Although in each of the above-mentioned image forming apparatuses according to the embodiments 5 to 10, in detecting the change in the environmental conditions under which the image forming apparatus is employed by the detecting means 110, the temperature sensor 91 for detecting the temperature of the ink 41 contained in the ink developing device 40 is provided, and the change in the viscosity of the ink 41 is detected by the ink viscosity detecting device 92 on the basis of the temperature measured by the temperature sensor 91, it is also possible to form an ink image of a test pattern on the surface of the image carrying member 10, measure the image density of the ink image by a density sensor 93, and detect the change in the environmental conditions under which the image forming apparatus is employed on the basis of the measurement, as shown in FIG. 14. It is desirable that the ink image of the test pattern is formed at predetermined timing, for example, immediately before printing is started and between pages.

Although in the above-mentioned embodiments 5 to 10, the viscosity of the ink 41 is found from the temperature of the ink 41, and each of control values (the thickness of the release agent 31, the viscosity of the release agent 31, the temperature of the ink 41, the rotational speed of the image carrying member 10, the nip width, etc.) is controlled from the viscosity of the ink 41, the control value may be directly read out and controlled from the temperature of the ink 41. For example, in the embodiment 5, the relationship between the temperature of the ink 41 and the thickness of the release agent 31 may be previously stored as a table, to read out and control the thickness of the release agent 31 (the contact pressure of the blade 33) corresponding to the temperature of the detected ink 41. Similarly in the other embodiments 6 to 10, the control value may be read out and controlled from the temperature of the ink 41.

In the embodiments 5 to 10, the change in the environmental conditions may be detected by detecting the pressure of the ink 41 applied to the regulating member 43 in the ink developing device 40 and detecting the viscosity of the ink 41 from the pressure.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An image forming apparatus comprising:

an image carrying member having an electrostatic latent image carried on its surface;

a release agent application device for applying a release agent to the surface of the image carrying member;

an ink developing device for bringing an ink into contact with the image carrying member having the electrostatic latent image formed thereon and the release agent applied thereto, to form an ink image corresponding to the electrostatic latent image; and an ink supplying device for supplying a replenishing ink to the ink developing device when the release agent is mixed with the ink in the ink developing device, wherein said replenishing ink differs in viscosity from the ink in the ink developing device.

2. The image forming apparatus according to claim 1, further comprising a controller for determining the amount of the release agent mixed with the ink in the ink developing device on the basis of image data, to control the supply of the replenishing ink by the ink supplying device on the basis of the amount of the mixed release agent.

3. The image forming apparatus according to claim 1, wherein said ink supplying device supplies the replenishing ink to the ink developing device, and said replenishing ink having a higher viscosity than that of the ink contained in the ink developing device.

4. The image forming apparatus according to claim 1, further comprising a transfer device for transferring the ink image formed on the image carrying member onto a recording medium.

5. An image forming apparatus comprising:

an image carrying member having an electrostatic latent image carried on its surface;

a release agent application device for applying a release agent to the surface of the image carrying member;

an ink developing device for bringing an ink into contact with the image carrying member having the electrostatic latent image formed thereon and the release agent applied thereto, to form an ink image corresponding to the electrostatic latent image; and a temperature adjusting device for adjusting the temperature of the ink in the ink developing device when the release agent is mixed with the ink in the ink developing device.

6. The image forming apparatus according to claim 5, further comprising a controller for determining the amount of the release agent mixed with the ink in the ink developing device on the basis of image data, to control the temperature of the ink by the temperature adjusting device on the basis of the amount of the mixed release agent.

7. The image forming apparatus according to claim 5, further comprising a transfer device for transferring the ink image formed on the image carrying member onto a recording medium.

8. An image forming apparatus comprising:

an image carrying member having an electrostatic latent image carried on its surface;

a release agent application device for applying a release agent to the surface of the image carrying member;

an ink developing device for bringing an ink into contact with the image carrying member having the electrostatic latent image formed thereon and the release agent applied thereto, to form an ink image corresponding to the electrostatic latent image;

detecting means for detecting a change in an environment in which the image forming apparatus is employed; and controlling means for controlling a time period elapsed until the ink reaches the surface of the image carrying member having the electrostatic latent image formed thereon through the release agent depending on the change in the environment detected by the detecting means.

9. The image forming apparatus according to claim 8, wherein said controlling means controls the thickness of the release agent applied to the surface of the image carrying member, to control the time period elapsed until the ink reaches the surface of the image carrying member having the electrostatic latent image formed thereon through the release agent.

10. The image forming apparatus according to claim 8, wherein said controlling means controls the viscosity of the release agent applied to the surface of the image carrying member, to control the time period elapsed until the ink reaches the surface of the image carrying member having the electrostatic latent image formed thereon through the release agent.

11. The image forming apparatus according to claim 8, wherein said controlling means controls the viscosity of the ink in the ink developing device, to control the time period elapsed until the ink reaches the surface of the image carrying member having the electrostatic latent image formed thereon through the release agent.

12. The image forming apparatus according to claim 8, further comprising a transfer device for transferring the ink image formed on the image carrying member onto a recording medium.

13. An image forming apparatus comprising:

an image carrying member having an electrostatic latent image carried on its surface;

a release agent application device for applying a release agent to the surface of the image carrying member;

an ink developing device for bringing an ink into contact with the image carrying member having the electrostatic latent image formed thereon and the release agent applied thereto, to form an ink image corresponding to the electrostatic latent image;

detecting means for detecting the change in an environment in which the image forming apparatus is employed; and controlling means for controlling, when an ink image is formed on the image carrying member by said ink developing device, a time period elapsed from the time when the ink is brought into contact with the image carrying member coated with the release agent until it is separated therefrom depending on the change in the environment detected by the detecting means.

14. The image forming apparatus according to claim 13, wherein said controlling means controls the speed at which the surface of the image carrying member moves.

15. The image forming apparatus according to claim 13, wherein said controlling means controls the distance, in the direction in which the image carrying member moves, from the point where the ink in the ink developing device is brought into contact with the image carrying member coated with the release agent to the point where it is separated therefrom.

16. An image forming method comprising the steps of:

forming an electrostatic latent image on the surface of an image carrying member;

applying a release agent to the surface of the image carrying member;

bringing an ink into contact with the image carrying member having the electrostatic latent image formed thereon and the release agent applied thereto by an ink developing device, to form an ink image corresponding to the electrostatic latent image; and supplying a replenishing ink to the ink developing device when the release agent is mixed with the ink in the ink developing device, wherein said replenishing ink differs in viscosity from the ink in the ink developing device.

17. An image forming method comprising the steps of:

forming an electrostatic latent image on the surface of an image carrying member;

applying a release agent to the surface of the image carrying member;

bringing an ink into contact with the image carrying member having the electrostatic latent image formed thereon and the release agent applied thereto by an ink developing device, to form an ink image corresponding to the electrostatic latent image; and adjusting the temperature of the ink in the ink developing device when the release agent is mixed with the ink in the ink developing device.

18. An image forming method comprising the steps of:

forming an electrostatic latent image on the surface of an image carrying member;

applying a release agent to the surface of the image carrying member;

bringing an ink into contact with the image carrying member having the electrostatic latent image formed thereon and the release agent applied thereto by an ink developing device, to form an ink image corresponding to the electrostatic latent image; and controlling a time period elapsed until the ink reaches the surface of the image carrying member having the electrostatic latent image formed thereon through the release agent depending on the change in an environment in which the image forming apparatus is employed.

19. An image forming method comprising the steps of:

forming an electrostatic latent image on the surface of an image carrying member;

applying a release agent to the surface of the image carrying member;

bringing an ink into contact with the image carrying member having the electrostatic latent image formed thereon and the release agent applied thereto by an ink developing device, to form an ink image corresponding to the electrostatic latent image; and controlling a time period elapsed from the time when the ink is brought into contact with the image carrying member coated with the release agent until it is separated therefrom in said step of forming the ink image depending on the change in an environment in which the image forming apparatus is employed.

* * * * *